US012723285B2

(12) United States Patent
Tsutsui et al.

(10) Patent No.: US 12,723,285 B2
(45) Date of Patent: Sep. 1, 2026

(54) HOT-ROLLED STEEL SHEET

(71) Applicant: NIPPON STEEL CORPORATION, Tokyo (JP)

(72) Inventors: Kazumasa Tsutsui, Tokyo (JP); Hiroshi Shuto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 394 days.

(21) Appl. No.: 18/579,802

(22) PCT Filed: Sep. 14, 2022

(86) PCT No.: PCT/JP2022/034417
§ 371 (c)(1),
(2) Date: Jan. 16, 2024

(87) PCT Pub. No.: WO2023/063014
PCT Pub. Date: Apr. 20, 2023

(65) Prior Publication Data

US 2024/0318274 A1 Sep. 26, 2024

(30) Foreign Application Priority Data

Oct. 11, 2021 (JP) ..... 2021-166960

(51) Int. Cl.
*C22C 38/04* (2006.01)
*C21D 8/02* (2006.01)
(Continued)

(52) U.S. Cl.
CPC ..... *C21D 8/0226* (2013.01); *C21D 8/02* (2013.01); *C21D 9/46* (2013.01); *C22C 38/02* (2013.01);
(Continued)

(58) Field of Classification Search
CPC ..... C22C 38/02; C22C 38/04; C22C 38/34; C22C 38/38; C22C 38/58; C21D 6/005;
(Continued)

(56) References Cited

U.S. PATENT DOCUMENTS

2023/0047602 A1* 2/2023 Tsutsui ..... C22C 38/001
2023/0279532 A1* 9/2023 Tsutsui ..... C21D 9/46
2023/0323496 A1* 10/2023 Yoshida ..... C21D 8/0226

FOREIGN PATENT DOCUMENTS

WO WO 2020/044445 A1 3/2020

OTHER PUBLICATIONS

Dayakar L. Naik et al., "Texture-Based Metallurgical Phase Identification in Structural Steels: A Supervised Machine Learning Approach", Metals 2019, 9, 546, pp. 1-26.
(Continued)

*Primary Examiner* — Vanessa T. Luk
(74) *Attorney, Agent, or Firm* — Birch, Stewart, Kolasch & Birch, LLP

(57) ABSTRACT

This hot-rolled steel sheet has a predetermined chemical composition, has a microstructure including, by area %, martensite and tempered martensite of more than 92.0% and 100.0% or less in total, residual austenite of less than 3.0%, ferrite of less than 5.0%, and in which an entropy value obtained by analyzing an SEM image of the microstructure using a gray-level co-occurrence matrix method is 11.0 or more, an inverse difference normalized value is less than 1.020, a cluster shade value is $-8.0\times10^5$ to $8.0\times10^5$, and a standard deviation of an Mn concentration is 0.60 mass % or less, and has a tensile strength of 980 MPa or more.

4 Claims, 1 Drawing Sheet

(51) Int. Cl.

| | |
|---|---|
| ***C21D 8/0221*** | (2026.01) |
| ***C21D 9/46*** | (2006.01) |
| ***C22C 38/02*** | (2006.01) |
| ***C22C 38/06*** | (2006.01) |

(52) U.S. Cl.
CPC ..... *C22C 38/04* (2013.01); *C22C 38/06* (2013.01); *C21D 2211/001* (2013.01); *C21D 2211/005* (2013.01); *C21D 2211/008* (2013.01)

(58) Field of Classification Search
CPC ..... C21D 2211/008; C21D 8/0226; C21D 8/0263; C21D 8/0426; C21D 8/0463
See application file for complete search history.

(56) References Cited

OTHER PUBLICATIONS

Johannes Webel et al., "A new analysis approach based on Haralick texture features for the characterization of microstructure on the example of low-alloy steels", Materials Characterization, 144 (2018), pp. 584-596.
Karel Zuiderveld, "Contrast Limited Adaptive Histogram Equalization", Chapter VIII.5, Graphics Gems IV. P.S. Heckbert (Eds.), Cambridge, MA, Academic Press, 1994, pp. 474-485.

* cited by examiner

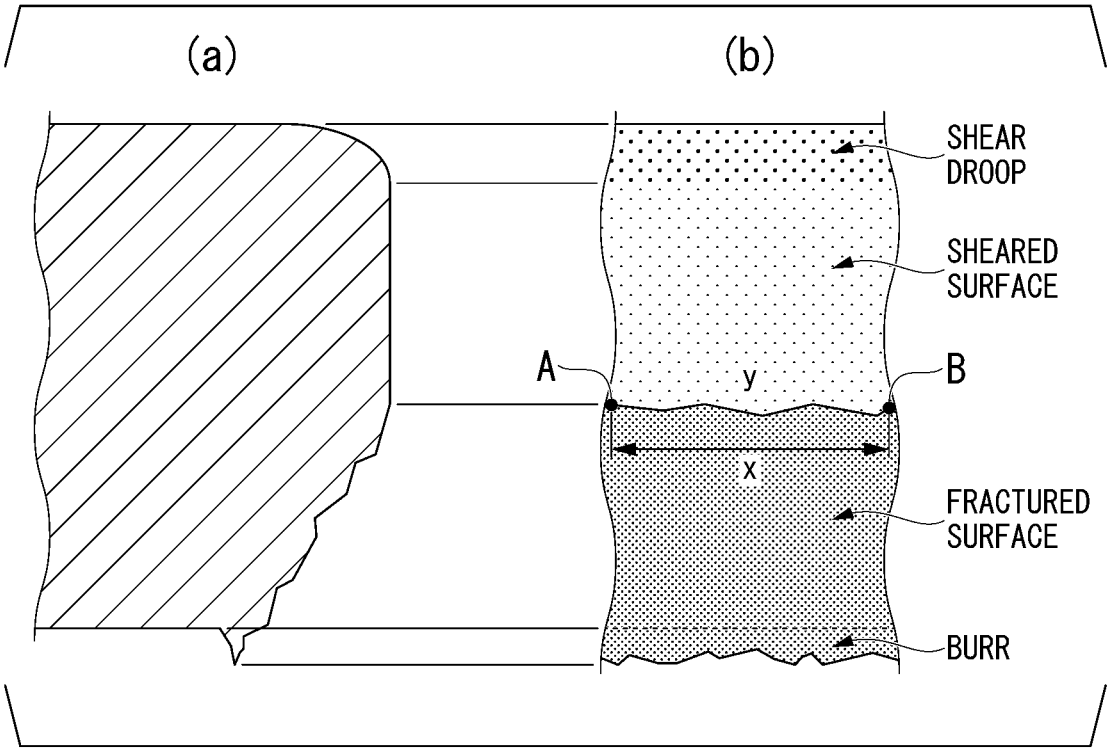
(a)
(b)
SHEAR DROOP
SHEARED SURFACE
A
B
y
x
FRACTURED SURFACE
BURR

HOT-ROLLED STEEL SHEET

TECHNICAL FIELD OF THE INVENTION

The present invention relates to a hot-rolled steel sheet. Specifically, the present invention relates to a hot-rolled steel sheet that is used by being formed into various shapes by press working or the like, and particularly to a hot-rolled steel sheet that has a high strength, a high limit fracture sheet thickness reduction ratio, and excellent hole expansibility and shearing property.

Priority is claimed on Japanese Patent Application No. 2021-166960, filed on Oct. 11, 2021, the content of which is incorporated herein by reference.

BACKGROUND ART

In recent years, from the viewpoint of protecting the global environment, efforts have been made to reduce the amount of carbon dioxide gas emitted in many fields. Vehicle manufacturers have also actively developed techniques for reducing the weight of vehicle bodies for the purpose of reducing fuel consumption. However, it is not easy to reduce the weight of vehicle bodies since the emphasis is placed on improvement in collision resistance to secure the safety of the occupants.

In order to achieve both vehicle body weight reduction and collision resistance, an investigation has been conducted to make a member thin by using a high strength steel sheet. Therefore, there is a strong demand for a steel sheet having both a high strength and excellent formability, and several techniques have been proposed to meet this demand. Since there are various working methods for vehicle members, the required formability differs depending on members to which the working methods are applied, but among these, the limit fracture sheet thickness reduction ratio and hole expansibility are placed as important indices for formability. The limit fracture sheet thickness reduction ratio is a value that is obtained from the sheet thickness of a tensile test piece before breaking and the minimum value of the sheet thickness of the tensile test piece after breaking. It is not preferable that the limit fracture sheet thickness reduction ratio be low since breaking is likely to occur in an early stage when tensile strain is applied during press forming.

Vehicle members are formed by press forming, and the press-formed blank sheets are often manufactured by highly productive shearing working. A blank sheet manufactured by shearing working needs to be excellent in terms of the end surface accuracy after shearing working.

For example, when a linearity of a boundary between a fractured surface and a sheared surface of the end surface is low, the accuracy of the sheared end surface significantly deteriorates.

For example, Patent Document 1 discloses a hot-rolled steel sheet as a material for a cold-rolled steel sheet that has excellent surface properties after press working and in which the Mn segregation degree and the P segregation degree are controlled at a center portion of the sheet thickness.

However, in Patent Document 1, the limit fracture sheet thickness reduction ratio and shearing property of the hot-rolled steel sheet are not considered.

PRIOR ART DOCUMENT

Patent Document

[Patent Document 1] PCT International Publication No. WO2020/044445

Non-Patent Documents

[Non-Patent Document 1] J. Webel, J. Gola, D. Britz, F. Mucklich, Materials Characterization 144 (2018) 584-596

[Non-Patent Document 2] D. L. Naik, H. U. Sajid, R. Kiran, Metals 2019, 9, 546

[Non-Patent Document 3] K. Zuiderveld, Contrast Limited Adaptive Histogram Equalization, Chapter VIII. 5, Graphics Gems IV. P. S. Heckbert (Eds.), Cambridge, MA, Academic Press, 1994, pp. 474-485

DISCLOSURE OF THE INVENTION

Problems to be Solved by the Invention

The present invention is contrived in view of the above-described circumstances, and an object of the present invention is to provide a hot-rolled steel sheet that has a high strength, a high limit fracture sheet thickness reduction ratio, and excellent hole expansibility and shearing property.

Means for Solving the Problem

The gist of the present invention is as follows.

(1) A hot-rolled steel sheet according to an aspect of the present invention containing, as a chemical composition, by mass %:

C: 0.040% to 0.250%;
Si: 0.05% to 3.00%;
Mn: 1.00% to 4.00%;
sol. Al: 0.001% to 0.500%;
P: 0.100% or less;
S: 0.0300% or less;
N: 0.1000% or less;
O: 0.0100% or less;
Ti: 0% to 0.300%;
Nb: 0% to 0.100%;
V: 0% to 0.500%;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.0200%;
As: 0% to 0.100%;
Zr: 0% to 1.00%;
Co: 0% to 1.00%;
Zn: 0% to 1.00%;
W: 0% to 1.00%;
Sn: 0% to 0.05%; and
a remainder: Fe and impurities,
in which Expression (A) is satisfied,
a microstructure includes, by area %,
martensite and tempered martensite of more than 92.0% and 100.0% or less in total,
residual austenite of less than 3.0%,
ferrite of less than 5.0%, and
in which an entropy value represented by Expression (1), obtained by analyzing an SEM image of the microstructure using a gray-level co-occurrence matrix method, is 11.0 or more,
an inverse difference normalized value represented by Expression (2) is less than 1.020, a cluster shade value represented by Expression (3) is $-8.0\times10^5$ to $8.0\times10^5$, and a standard deviation of an Mn concentration is 0.60 mass % or less, and a tensile strength is 980 MPa or more, $$Zr + Co + Zn + W \leq 1.00\% \quad (A)$$

where each element symbol in Expression (A) represents an amount of the corresponding element by mass %, and 0% is substituted in a case where the corresponding element is not contained, here, P(i, j) in Expressions (1) to (5) is a gray-level co-occurrence matrix, L in Expression (2) is the number of grayscale levels that can be taken in the SEM image, i and j in Expressions (2) and (3) are natural numbers of 1 to L, and $\mu_x$ and $\mu_y$ in Expression (3) are each represented by Expressions (4) and (5).

$$\text{Entropy} = -\sum_i \sum_j P(i, j) \cdot \log(P(i, j)) \quad (1)$$

$$\text{Inverse difference normalized} = \sum_i \sum_j \frac{P(i, j)}{1 + \frac{|i-j|}{L}} \quad (2)$$

$$\text{Cluster Shade} = \sum_i \sum_j (i + j - \mu_x - \mu_y)^3 P(i, j) \quad (3)$$

$$\mu_x = \sum_i \sum_j i(P(i, j)) \quad (4)$$

$$\mu_y = \sum_i \sum_j j(P(i, j)) \quad (5)$$

(2) In the hot-rolled steel sheet according to (1), an average crystal grain size of a surface layer may be less than 3.0 km.

(3) In the hot-rolled steel sheet according to (1) or (2), the chemical composition may contain, by mass %, one or two or more selected from the group consisting of Ti: 0.001% to 0.300%,
Nb: 0.001% to 0.100%,
V: 0.001% to 0.500%,
Cu: 0.01% to 2.00%,
Cr: 0.01% to 2.00%,
Mo: 0.01% to 1.00%,
Ni: 0.01% to 2.00%,
B: 0.0001% to 0.0100%,
Ca: 0.0001% to 0.0200%,
Mg: 0.0001% to 0.0200%,
REM: 0.0001% to 0.1000%,
Bi: 0.0001% to 0.0200%,
As: 0.001% to 0.100%,
Zr: 0.01% to 1.00%,
Co: 0.01% to 1.00%,
Zn: 0.01% to 1.00%,
W: 0.01% to 1.00%, and
Sn: 0.01% to 0.05%.

Effects of the Invention

In the aspect according to the present invention, it is possible to obtain a hot-rolled steel sheet that has a high strength, a high limit fracture sheet thickness reduction ratio, and excellent hole expansibility and shearing property. In addition, in the preferable aspect according to the present invention, it is possible to obtain a hot-rolled steel sheet that has the above various properties and, furthermore, suppresses the occurrence of inside bend cracking, that is, has excellent inside bend cracking resistance.

The hot-rolled steel sheet according to the aspect of the present invention is suitable as an industrial material used for vehicle members, mechanical structural members, and building members.

BRIEF DESCRIPTION OF THE DRAWINGS

FIG. 1 is a view for describing a method of measuring the linearity of a boundary between a fractured surface and a sheared surface on an end surface after shearing working.

EMBODIMENTS OF THE INVENTION

Hereinafter, the chemical composition and microstructure of a hot-rolled steel sheet according to the present embodiment will be described in greater detail. However, the present invention is not limited to configuration disclosed in the present embodiment, and various modifications can be made without departing from the gist of the present invention.

The numerical limit range described below with "to" in between includes the lower limit and the upper limit. Numerical values indicated as "less than" or "more than" do not fall within the numerical range. In the following description, % regarding the chemical composition is mass % unless otherwise specified.

Chemical Composition

Hereinafter, the chemical composition of the hot-rolled steel sheet according to the present embodiment will be described in detail.

C: 0.040% to 0.250%

C increases the area ratio of a hard phase. In addition, C increases the strength of martensite by bonding to a precipitation hardening element such as Ti, Nb, or V. In a case where the C content is less than 0.040%, it is not possible to obtain a desired strength. In addition, in a case where the C content is less than 0.040%, ferrite fraction increases and the I value also increases due to the influence of the flat ferrite structure. Therefore, the C content is set to 0.040% or more. The C content is preferably 0.060% or more, more preferably 0.070% or more, or 0.080% or more.

Meanwhile, in a case where the C content is more than 0.250%, the formation of ferrite having low strength is promoted and the area ratio of martensite and tempered martensite decreases. Thus, the strength of the hot-rolled steel sheet decreases. In addition, in a case where the C content is more than 0.250%, the E value decreases due to the influence of the increase in the flat cementite structure and the formation of carbide regions with small brightness differences. Therefore, the C content is set to 0.250% or less, or 0.220% or less. The C content is preferably 0.200% or less, 0.170% or less, 0.150% or less, or 0.120% or less.

Si: 0.05% to 3.00%

Si has the effect of retarding the precipitation of cementite. Due to this effect, the area ratio of martensite and tempered martensite can be increased, and the strength of the hot-rolled steel sheet can be increased by solid solution strengthening. In addition, Si acts to achieve soundness of steel by deoxidation (suppressing the occurrence of defects such as blowholes in the steel). In a case where the Si content is less than 0.05%, it is not possible to obtain the effects of the actions. In addition, in a case where the Si content is less than 0.05%, the I value also increases due to the influence of the increase in the flat cementite structure and the formation of carbide regions with small brightness differences. Therefore, the Si content is set to 0.05% or more. The Si content is preferably 0.50% or more, and more preferably 0.80% or more, or 1.00% or more.

Meanwhile, in a case where the Si content is more than 3.00%, the surface properties, chemical convertibility, and weldability of a steel sheet significantly deteriorate, and the $A_3$ transformation point is significantly increased. Therefore, it becomes difficult to perform hot rolling in a stable manner. In addition, in a case where the Si content is more than 3.00%, the area ratio of ferrite increases and the E value decreases due to the influence of the flat ferrite structure. Therefore, the Si content is set to 3.00% or less. The Si content is preferably 2.70% or less, and more preferably 2.50% or less, 2.20% or less, 2.00% or less, 1.80% or less, or 1.50% or less.

Mn: 1.00% to 4.00%

Mn acts to suppress ferritic transformation, thereby increasing the strength of the hot-rolled steel sheet. In a case where the Mn content is less than 1.00%, it is not possible to obtain a desired strength. Therefore, the Mn content is set to 1.00% or more. The Mn content is preferably 1.50% or more, 2.00% or more, or 2.30% or more.

Meanwhile, in a case where the Mn content is more than 4.00%, due to the segregation of Mn, a misorientation of crystal grains in the hard phase becomes non-uniform, and the linearity of the boundary between the fractured surface and the sheared surface of the end surface after shearing working decreases. In addition, in a case where the Mn content is more than 4.00%, the area ratio of residual austenite increases, and the I value also increases due to the influence of the flat residual austenite structure. Therefore, the Mn content is set to 4.00% or less. The Mn content is preferably 3.70% or less, 3.50% or less, 3.20% or less, or 2.90% or less.

sol. Al: 0.001% to 0.500%

Similar to Si, Al acts to deoxidize steel, thereby achieving soundness of the steel, and to suppress the precipitation of cementite from austenite, thereby increasing the area ratio of martensite and tempered martensite. In a case where the sol. Al content is less than 0.001%, it is not possible to obtain the effects of the actions. Therefore, the sol. Al content is set to 0.001% or more. The sol. Al content is preferably 0.010% or more, 0.030% or more, or 0.050% or more, and more preferably 0.080% or more, 0.100% or more, or 0.150% or more.

Meanwhile, in a case where the sol. Al content is more than 0.500%, the above effects are saturated, which is not economically preferable. Accordingly, the sol. Al content is set to 0.500% or less. The sol. Al content is preferably 0.400% or less, and even more preferably 0.300% or less, or 0.250% or less.

In the present embodiment, the sol. Al means acid-soluble Al and refers to solid solution Al present in steel in a solid solution state.

P: 0.100% or less

P is an element that is generally contained as an impurity, but acts to increase the strength by solid solution strengthening. Therefore, P may be positively contained. However, P is an element that is easily segregated. In a case where the P content is more than 0.100%, limit fracture sheet thickness reduction ratio attributed to boundary segregation are significantly decreased. Therefore, the P content is set to 0.100% or less. The P content is preferably 0.050% or less, 0.030% or less, 0.020% or less, or 0.015% or less. The lower limit of the P content does not need to be particularly specified, and the lower limit of the P content is 0%. From the viewpoint of the refining cost, the lower limit of the P content may be 0.001%, 0.003%, or 0.005%.

S: 0.0300% or less

S is an element that is contained as an impurity and forms a sulfide-based inclusion in steel, thereby decreasing the hole expansibility and limit fracture sheet thickness reduction ratio of the hot-rolled steel sheet. In a case where the S content is more than 0.0300%, the hole expansibility and limit fracture sheet thickness reduction ratio of the hot-rolled steel sheet are significantly decreased. Therefore, the S content is set to 0.0300% or less. The S content is preferably 0.0100% or less, 0.0070% or less, or 0.0050% or less. The lower limit of the S content does not need to be particularly specified, the lower limit of the S content is 0%. The lower limit of the S content may be 0.0001%, 0.0005%, 0.0010%, or 0.0020% from the viewpoint of the refining cost.

N: 0.1000% or less

N is an element that is contained in steel as an impurity and acts to decrease the hole expansibility and limit fracture sheet thickness reduction ratio of the hot-rolled steel sheet. In a case where the N content is more than 0.1000%, the hole expansibility and limit fracture sheet thickness reduction ratio of the hot-rolled steel sheet are significantly decreased. Therefore, the N content is set to 0.1000% or less. The N content is preferably 0.0800% or less, more preferably 0.0700% or less or 0.0500% or less.

The lower limit of the N content does not need to be particularly specified, and the lower limit of the N content is 0%. The lower limit of the N content may be 0.0001%. In a case where one or two or more of Ti, Nb, and V are contained to refine the microstructure as described below, the N content is preferably set to 0.0010% or more, and more preferably set to 0.0020% or more, 0.0080% or more, or 00150% or more in order to promote the precipitation of a carbonitride.

O: 0.0100% or less

In a case where a large amount of O is contained in steel, O forms a coarse oxide that serves as a fracture initiation point, and causes brittle fracture and hydrogen-induced cracks. Therefore, the O content is set to 0.0100% or less. The O content is preferably 0.0080% or less, 0.0050% or less or 0.0030% or less. The lower limit of the O content is 0%, but in order to disperse a large number of fine oxides during deoxidation of molten steel, the O content may be set to 0.0005% or more or 0.0010% or more.

The hot-rolled steel sheet according to the present embodiment may contain the following elements as optional elements in addition to the above elements. In a case where the optional elements are not contained, the lower limit of the content thereof is 0%. Hereinafter, the optional elements will be described in detail.

Ti: 0.001% to 0.300%

Nb: 0.001% to 0.100%

V: 0.001% to 0.500%

Ti, Nb, and V are elements that are precipitated in steel as a carbide and a nitride and have the effect to refine the microstructure due to the pinning effect. Therefore, one or two or more of these elements may be contained. In order to more reliably obtain the effects of the effects, the Ti content is preferably set to 0.001% or more, the Nb content is preferably set to 0.001% or more, or the V content is preferably set to 0.001% or more. That is, it is preferable that the content of at least one of Ti, Nb and V is 0.001% or more.

However, in a case where these elements are contained in excess, the effects of the above actions are saturated, which is not economically preferable. Therefore, the Ti content is set to 0.300% or less, the Nb content is set to 0.100% or less, and the V content is set to 0.500% or less.

Cu: 0.01% to 2.00%

Cr: 0.01% to 2.00%

Mo: 0.01% to 1.00%

Ni: 0.01% to 2.00%

B: 0.0001% to 0.0100%

All of Cu, Cr, Mo, Ni, and B act to increase the hardenability of the hot-rolled steel sheet. In addition, Cu and Mo act to increase the strength by being precipitated as a carbide in the steel at low temperature. Furthermore, in a case where Cu is contained, Ni acts to effectively suppress the intergranular cracking of a slab caused by Cu. Therefore, one or two or more of these elements may be contained.

As described above, Cu acts to increase the hardenability of the hot-rolled steel sheet and to increase the strength of the hot-rolled steel sheet by being precipitated as a carbide in the steel at a low temperature. In order to more reliably obtain the effects of the actions, the Cu content is preferably set to 0.01% or more, and more preferably set to 0.05% or more. However, in a case where the Cu content is more than 2.00%, intergranular cracking may occur in a slab. Therefore, the Cu content is set to 2.00% or less. The Cu content is preferably 1.50% or less, and more preferably 1.00% or less, 0.70% or less, or 0.50% or less.

As described above, Cr acts to increase the hardenability of the hot-rolled steel sheet and increase the strength by being precipitated as a carbide in the steel at low temperature. In order to more reliably obtain the effect of the action, the Cr content is preferably set to 0.01% or more, and more preferably set to 0.05% or more. However, in a case where the Cr content is more than 2.00%, the chemical convertibility of the hot-rolled steel sheet is significantly decreased. Therefore, the Cr content is set to 2.00% or less. The Cr content is preferably 1.50% or less, and more preferably 1.00% or less, 0.70% or less, or 0.50% or less.

As described above, Mo acts to increase the hardenability of the hot-rolled steel sheet and to increase the strength of the hot-rolled steel sheet by being precipitated as a carbide in the steel. In order to more reliably obtain the effects of the actions, the Mo content is preferably set to 0.01% or more, and more preferably set to 0.02% or more. However, from the economic perspective, it is not preferable that the Mo content be set to more than 1.00% since the effects of the actions are saturated. Therefore, the Mo content is 1.00% or less. The O content is preferably 0.50% or less, and more preferably 0.20% or less or 0.10% or less.

As described above, Ni acts to increase the hardenability of the hot-rolled steel sheet. In addition, in a case where Cu is contained, Ni acts to effectively suppress the intergranular cracking of a slab caused by Cu. In order to more reliably obtain the effects of the actions, the Ni content is preferably set to 0.01% or more. Since Ni is an expensive element, it is not economically preferable to contain a large amount of Ni. Therefore, the Ni content is set to 2.00% or less. The Ni content is preferably 1.50% or less, and more preferably 1.00% or less, 0.70% or less, or 0.50% or less.

As described above, B acts to increase the hardenability of the hot-rolled steel sheet. In order to more reliably obtain the effect of the action, the B content is preferably set to 0.0001% or more, and more preferably set to 0.0002% or more. However, in a case where the B content is more than 0.0100%, the hole expansibility of the hot-rolled steel sheet is significantly decreased, and thus the B content is set to 0.0100% or less. The B content is preferably 0.0050% or less or 0.0025% or less.

Ca: 0.0001% to 0.0200%

Mg: 0.0001% to 0.0200%

REM: 0.0001% to 0.1000%

Bi: 0.0001% to 0.0200%

As: 0.001% to 0.100%

All of Ca, Mg, and REM act to increase the hole expansibility of the hot-rolled steel sheet by adjusting the shape of inclusions to a preferable shape. In addition, Bi acts to increase the formability of the hot-rolled steel sheet by refining the solidification structure. Therefore, one or two or more of these elements may be contained. In order to more reliably obtain the effects of the actions, the amount of any one or more of Ca, Mg, REM, and Bi is preferably set to 0.0001% or more. However, in a case where the Ca content or Mg content is more than 0.0200% or the REM content is more than 0.1000%, an inclusion is excessively formed in steel, and thus the hole expansibility of the hot-rolled steel sheet may be conversely decreased. In addition, from the economic perspective, it is not preferable that the Bi content be set to more than 0.0200% since the effects of the actions are saturated. Therefore, the Ca content and the Mg content are set to 0.0200% or less, the REM content is set to 0.1000% or less, and the Bi content is set to 0.0200% or less. The Ca content, Mg content, and Bi content are preferably 0.0100% or less, and more preferably 0.0070% or less or 0.0040% or less. The REM content is preferably 0.0070% or less or 0.0040% or less. As refines prior austenite grains by lowering an austenite single-phase formation temperature, thereby contributing to an improvement in ductility of the hot-rolled steel sheet. In order to reliably obtain the effects, the As content is preferably set to 0.001% or more. Meanwhile, since the above effects are saturated even in a case where a large amount of As is contained, the As content is set to 0.100% or less.

Here, REM refers to a total of 17 elements consisting of Sc, Y, and lanthanoids, and the REM content refers to the total amount of these elements. Lanthanoids are industrially added in the form of misch metal.

Zr: 0.01% to 1.00%, Co: 0.01% to 1.00%, Zn: 0.01% to 1.00%, W: 0.01% to 1.00%

$$Zr + Co + Zn + W \leq 1.00\% \quad (A)$$

Here, each element symbol in Expression (A) represents the amount of the corresponding element by mass %, and 0% is substituted in a case where the corresponding element is not contained.

Sn: 0% to 0.05%

Regarding Zr, Co, Zn, and W, the present inventors have confirmed that, even in a case where these elements are contained in an amount of 1.00% or less in total, the effects of the hot-rolled steel sheet according to the present embodiment are not impaired. Therefore, one or two or more of Zr, Co, Zn, and W may be contained in an amount of 1.00% or less in total. That is, the value of the left side of Expression (A) may be set to 1.00% or less, 0.50% or less, 0.10% or less, or 0.05% or less. Each of the Zr content, the Co content, the Zn content, the W content, and the Sn content may be set to 0.50% or less, 0.10% or less, or 0.05% or less. Since Zr, Co, Zn, and W do not have to be contained, the amount of each of Zr, Co, Zn, and W may be 0%. In order to improve the strength by solid solution strengthening of the steel sheet, each of the Zr content, the Co content, the Zn content, and the W content may be 0.01% or more.

In addition, the present inventors have confirmed that, even in a case where Sn is contained in a small amount, the effects of the hot-rolled steel sheet according to the present embodiment are not impaired. However, in a case where a large amount of Sn is contained, a defect may be generated during hot rolling, and thus the Sn content is set to 0.05% or less. Since Sn does not have to be contained, the Sn content may be 0%. In order to increase the corrosion resistance of the hot-rolled steel sheet, the Sn content may be 0.01% or more.

The remainder of the chemical composition of the hot-rolled steel sheet according to the present embodiment may consist of Fe and impurities. In the present embodiment, the impurities mean substances incorporated from ore as a raw material, a scrap, manufacturing environment, or the like and substances permitted to an extent that the hot-rolled steel sheet according to the present embodiment is not adversely affected.

The chemical composition of the above hot-rolled steel sheet may be measured by a general analytical method. For example, the chemical composition may be measured using inductively coupled plasma-atomic emission spectrometry (ICP-AES). sol. Al may be measured by ICP-AES using a filtrate obtained by heating and decomposing a sample with an acid. In addition, C and S may be measured using a combustion-infrared absorption method, N may be measured using an inert gas fusion-thermal conductivity method, and O may be measured using an inert gas fusion-non-dispersive infrared absorption method.

In a case where the hot-rolled steel sheet is provided with a plating layer on the surface, the chemical composition may be analyzed after removing the plating layer by mechanical grinding or the like, as necessary.

Microstructure of Hot-Rolled Steel Sheet

Next, the microstructure of the hot-rolled steel sheet according to the present embodiment will be described.

The hot-rolled steel sheet according to the present embodiment has a microstructure including, by area %, martensite and tempered martensite of more than 92.0% and 100.0% or less in total, residual austenite of less than 3.0%, ferrite of less than 5.0%, in which an entropy value represented by Expression (1), obtained by analyzing an SEM image of the microstructure using a gray-level co-occurrence matrix method, is 11.0 or more, an inverse difference normalized value represented by Expression (2) is less than 1.020, a cluster shade value represented by Expression (3) is $-8.0\times10^5$ to $8.0\times10^5$, and a standard deviation of an Mn concentration is 0.60 mass % or less.

Therefore, the hot-rolled steel sheet according to the present embodiment can obtain excellent hole expansibility and shearing property while having a high strength and a high limit fracture sheet thickness reduction ratio. In the present embodiment, the microstructure in a cross section parallel to the rolling direction at a depth position ¼ of the sheet thickness away from the surface (a region ranging from a depth of ⅛ of the sheet thickness from the surface to a depth of ⅜ of the sheet thickness from the surface) at a center position in the sheet width direction are specified. The reason therefor is that the microstructures at the position indicate typical microstructures of the steel sheet.

The surface mentioned here refers to the interface between a plating layer and the steel sheet in a case where the hot-rolled steel sheet is provided with the plating layer.

Area Ratio of Residual Austenite: Less than 3.0%

Residual austenite is a microstructure that is present as a face-centered cubic lattice even at room temperature. Residual austenite acts to increase the hole expansibility of the hot-rolled steel sheet by transformation-induced plasticity (TRIP). Meanwhile, residual austenite transforms into high-carbon martensite during shearing working, which inhibits the stable occurrence of cracking and causes the decrease of the linearity of the boundary between the fractured surface and the sheared surface of the end surface after shearing working. In a case where the area ratio of the residual austenite is 3.0% or more, the action is actualized, and the linearity of the boundary between the fractured surface and the sheared surface of the end surface after shearing working decreases. Therefore, the area ratio of the residual austenite is set to less than 3.0%. The area ratio of the residual austenite is preferably 1.5% or less, and more preferably less than 1.0%. Since residual austenite is preferably as little as possible, the area ratio of the residual austenite may be 0%. However, it is not easy to set the area ratio of retained austenite to 0%, and the lower limit may be set to 0.5% or 1.0%.

Area Ratio of Ferrite: Less than 5.0%

Ferrite is generally a soft microstructure. In a case where a predetermined amount or more of ferrite is contained, a desired strength may not be obtained, and the region of the sheared surface on the end surface after shearing working may increase. In a case where the region of the sheared surface on the end surface after shearing working increases, the linearity of the boundary between the fractured surface and the sheared surface of the end surface decreases, which is not preferable. In a case where the area ratio of ferrite is 5.0% or more, the above action is actualized. Therefore, the area ratio of ferrite is set to less than 5.0%. The area ratio of ferrite is preferably 3.0% or less, more preferably 2.0% or less, and even more preferably less than 1.0%. Since ferrite is preferably as little as possible, the area ratio of ferrite may be 0%. However, it is not easy to set the area ratio of ferrite to 0%, and the lower limit may be set to 0.5%, 1.0% or 1.5%.

As a method of measuring the area ratio of the residual austenite, methods by X-ray diffraction, electron back scatter diffraction image (EBSP, electron back scattering diffraction pattern) analysis, and magnetic measurement and the like are known. In the present embodiment, the area ratio of the residual austenite is measured by X-ray diffraction that makes it relatively easy to obtain accurate measurement results and is hardly affected by polishing, since it is less susceptible to polishing (when affected by polishing, the residual austenite may be converted into another phase such as martensite, so that the true area ratio may not be measured).

In the measurement of the area ratio of the residual austenite by X-ray diffraction in the present embodiment, first, the integrated intensities of a total of 6 peaks of $\alpha(110)$, $\alpha(200)$, $\alpha(211)$, $\gamma(111)$, $\gamma(200)$, and $\gamma(220)$ are obtained in a sheet thickness-directional cross section parallel to the rolling direction at a ¼ depth position of the sheet thickness (a region ranging from a depth of ⅛ of the sheet thickness from the surface to a depth of ⅜ of the sheet thickness from the surface) at a center position in the sheet width direction of the hot-rolled steel sheet using Co—K$\alpha$ rays, and the volume percentage of the residual austenite is obtained by calculation using the strength averaging method. The obtained volume percentage of the residual austenite is regarded as the area ratio of the residual austenite.

The measurement of the area ratio of ferrite is conducted by the following method. A sheet thickness-directional cross section parallel to the rolling direction is mirror-finished and, furthermore, polished at room temperature with colloidal silica not containing an alkaline solution for 8 minutes, thereby removing strain introduced into the surface layer of a sample. In a random position of the sample cross section in a longitudinal direction, a 50 μm-long region at a region ranging from a depth of ⅛ of the sheet thickness from the surface to a depth of ⅜ of the sheet thickness from the surface is measured by an electron backscatter diffraction method at a measurement interval of 0.1 μm to obtain crystal orientation information. For the measurement, an EBSD analyzer composed of a thermal field emission scanning electron microscope (JSM-7001F manufactured by JEOL) and an EBSD detector (DVC5 type detector manufactured by TSL) is used. In this case, the degree of vacuum inside the EBSD analyzer is set to $9.6\times10^{-5}$ Pa or less, the acceleration voltage is set to 15 kV, the irradiation current level is set to 13, and the electron beam irradiation level is set to 62. The observation area is set to 40,000 $\mu m^2$.

Next, a reflected electron image is captured in the same visual field. Crystal grains in which ferrite and cementite are precipitated in layers are specified from the reflected electron image, and the area ratio of the crystal grains is calculated, whereby the area ratio of pearlite can be obtained.

After that, for crystal grains determined to have a body-centered cubic lattice structure among crystal grains except the crystal grains determined as pearlite, from the obtained crystal orientation information, regions where the grain average misorientation value is 1.0° or less are determined as ferrite using a "Grain Average Misorientation" function mounted in software "OIM Analysis (registered trademark)" included in the EBSD analyzer. In that case, the grain tolerance angle is set to 150 and the area ratio of the regions determined as ferrite is obtained to obtain an area ratio of ferrite.

Next, in regions except the regions determined as pearlite or ferrite, when the maximum value of "Grain Average IQ" of the ferrite regions is represented by Iα, regions where "Grain Average IQ" becomes more than Iα/2 are extracted (determined) as bainite. The area ratio of the regions extracted (determined) as bainite is calculated to obtain the area ratio of bainite.

Total Area Ratio of Martensite and Tempered Martensite: More than 92.0% and 100.0% or Less In a case where the total area ratio of martensite and tempered martensite is 92.0% or less, a desired strength cannot be obtained. Therefore, the total area ratio of martensite and tempered martensite is set to more than 92.0%. The total area ratio is preferably 93.0% or more, 95.0% or more, 97.0% or more, or 99.0% or more. The total area ratio of martensite and tempered martensite is preferably as large as possible and thus may be set to 100.0%.

A method for measuring the area ratio of martensite and tempered martensite will be described below.

First, in order to observe the same region as the EBSD measurement region in which the area ratio of ferrite has been measured with a SEM, a Vickers indentation is stamped in the vicinity of an observation position. After that, the structure of an observed section is left, contamination on the surface layer is removed by polishing, and Nital etching is performed. Next, the same visual field as the EBSD observed section is observed with the SEM at a magnification of 3000 times.

In the EBSD measurement, among regions determined as a structure other than ferrite, a region in which a substructure is present within grains and cementite is precipitated in a plurality of variant forms is determined as tempered martensite. A region in which the brightness is high and a substructure is not exposed by etching is determined as "martensite or residual austenite". The area ratio of each is calculated, whereby the area ratio of the tempered martensite and the area ratio of "martensite and residual austenite" are obtained. The area ratio of martensite is obtained by subtracting the area ratio of residual austenite obtained by the above X-ray diffraction from the obtained area ratio of "martensite and residual austenite". The total area ratio of martensite and the area ratio of tempered martensite is calculated, whereby the total of the area ratio of martensite and tempered martensite is obtained.

Regarding the removal of contaminant on the surface layer of the observed section, a method such as buffing using alumina particles having a particle size of 0.1 μm or less Ar ion sputtering may be used.

In the hot-rolled steel sheet according to the present embodiment, as the remainder in microstructure, one or two of bainite and pearlite may be contained in a total area ratio of 0% or more and less than 8.0%. The upper limit of the area ratio of the reminder in microstructure may be 6.0%, 5.0%, 4.0%, 3.0%, or 2.5%.

In the present embodiment, since the area ratios of the structures are measured by X-ray diffraction, EBSD analysis and SEM observation, the total of the area ratios of the structures obtained by the measurement may not be 100.0%. In a case where the total of the area ratios of the structures obtained by the above method does not reach 100.0%, the area ratios of the structures are converted so that the total of the area ratios of the structures reaches 100.0%. For example, in a case where the total of the area ratios of the structures is 103.0%, the area ratio of each structure is multiplied by "100.0/103.0" to obtain the area ratio of each structure.

Entropy Value: 11.0 or More, Inverse Difference Normalized Value: Less than 1.020

In order to increase the linearity of the boundary between the fractured surface and the sheared surface of the end surface after shearing working, it is important to decrease the periodicity of the microstructure and decrease the uniformity of the microstructure. In the present embodiment, the linearity of the boundary between the fractured surface and the sheared surface of the end surface after shearing working is increased by controlling the entropy value (E value) representing the periodicity of the microstructure and the inverse difference normalized value (I value) representing the uniformity of the microstructure.

The E value represents the periodicity of the microstructure. In a case where the brightness is periodically arranged due to an influence of the formation of a band-like structure or the like, that is, the periodicity of the microstructure is high, the E value decreases. In the present embodiment, since there is a need to make the microstructure poorly periodic, it is necessary to increase the E value. In a case where the E value is less than 11.0, the linearity of the boundary between the fractured surface and the sheared surface of the end surface after shearing working is likely to be decreased. From periodically arranged structures as initiation points, cracking occurs from the cutting edge of a shearing tool in an extremely early stage of shearing working to form a fractured surface, and then a sheared surface is formed again. In a microstructure where the periodicity is high, that is, the E value is low, cracking occurs from periodically arranged structures as starting points along a plurality of band-like structures present in the vicinities of the starting points to form a fractured surface. This is presumed to make the linearity of the boundary between a fractured surface and the sheared surface of the end surface after shearing working likely to decrease. Therefore, the E value is set to 11.0 or more. The E value is preferably 11.1 or more, and more preferably 11.2 or more. The E value is preferably as high as possible, and the upper limit is not particularly specified and may be set to 13.5 or less, 13.0 or less, 12.5 or less, or 12.0 or less.

The I value represents the uniformity of the microstructure, and increases as the area of a region having certain brightness increases. A high I value means that the uniformity of the microstructure is high. In the hot-rolled steel sheet according to the present embodiment that has a microstructure with the total area ratio of martensite and tempered martensite of more than 92.0%, it is necessary to make the microstructure mainly composed of martensite with low uniformity of brightness. Thus, there is a need to reduce the I value. In a case where the uniformity of the microstructure is high, that is, the I value is high, cracking is likely to occur from the tip of a shearing tool due to an influence of hardness difference attributed to precipitates in crystal grains, an element concentration difference, and soft ferrite. As a result, the linearity of the boundary between the fractured surface and the sheared surface of the end surface after shearing working likely to decrease. And thus, in a case where the I value is 1.020 or more, it is presumed that it is not possible to increase the linearity of the boundary between the fractured surface and the sheared surface of the end surface after shearing working. Therefore, the I value is set to less than 1.020. The I value is preferably 1.015 or less, and more preferably 1.010 or less. The lower limit of the I value is not particularly specified and may be set to 0.900 or more, 0.950 or more, or 1.000 or more.

Cluster Shade Value: $-8.0\times10^5$ to $8.0\times10^5$

The Cluster shade value (CS value) represents the degree of strain of the microstructure. The CS value becomes a positive value in a case where there are many points having higher brightness than an average value of brightness in an image obtained by photographing the microstructure, and the CS value becomes a negative value in a case where there are many points having lower brightness than the average value.

In a secondary electron image of a scanning electron microscope, the brightness is high at places where the surface unevenness of a target to be observed is large, and the brightness is low at places where the unevenness is small. The surface unevenness of the target to be observed is greatly affected by the grain size and the strength distribution in the microstructure. In the present embodiment, in a case where the variation in strength of the microstructure is large or the structural unit is small, the CS value is large, and in a case where the variation in strength is small or the structural unit is large, the CS value is small.

In the present embodiment, it is important to keep the CS value within a desired range close to zero. In a case where the CS value is less than $-8.0\times10^5$, the limit fracture sheet thickness reduction ratio of the hot-rolled steel sheet is decreased. The reason for this is presumed to be that there are crystal grains having a large grain size in the microstructure and the crystal grains preferentially fracture during ultimate deformation. Therefore, the CS value is set to $-8.0\times10^5$ or more. The CS value is preferably $-7.5\times10^5$ or more, and more preferably $-7.0\times10^5$ or more.

Meanwhile, in a case where the CS value is more than $8.0\times10^5$, the limit fracture sheet thickness reduction ratio of the hot-rolled steel sheet is decreased. The reason for this is presumed to be that the variation in microscopic strength is large in the microstructure, strain is locally concentrated during ultimate deformation, and thus fracture is likely to occur. Therefore, the CS value is set to $8.0\times10^5$ or less. The CS value is preferably $7.5\times10^5$ or less, and more preferably $7.0\times10^5$ or less.

The E value, the I value, and the CS value can be obtained by the following method.

In the present embodiment, a region where an SEM image (a secondary electron image of a scanning electron microscope) is captured to calculate the E value, the I value, and the CS value is set in a sheet thickness-directional cross section parallel to the rolling direction at a depth position ¼ of the sheet thickness away from the surface (a region ranging from a depth of ⅛ of the sheet thickness from the surface to a depth of ⅜ of the sheet thickness from the surface) at a center position in the sheet width direction. The SEM image is captured using an SU-6600 Schottky electron gun manufactured by Hitachi High-Technologies Corporation with a tungsten emitter and an acceleration voltage of 1.5 kV. Based on the above settings, the SEM image is output at a magnification of 1,000 times in 256 grayscale levels.

Next, on an image obtained by cutting out the obtained SEM image into an 880×880-pixel region (the observation region is 160 μm×160 μm in actual size), a smoothing treatment described in Non-Patent Document 3, in which the contrast-enhanced limit magnification is set to 2.0 and the tile grid size is 8×8 is performed. The smoothed SEM image is rotated counterclockwise from 0 degrees to 179 degrees in increments of 1 degree, excluding 90 degrees, and an image is created at each angle, thereby obtaining a total of 179 images. Next, from each of these 179 images, the frequency values of brightness between adjacent pixels are sampled in a matrix form using the GLCM method described in Non-Patent Document 1.

179 matrixes of the frequency values sampled by the above method are expressed as $p_k$ (k=0 . . . 89, 91, . . . 179) where k is a rotation angle from the original image. $p_k$'s generated for the individual images are summed for all k's (k=0 . . . 89, 91, . . . 179), and then 256×256 matrixes P standardized such that the total of individual components becomes 1 are calculated. Furthermore, the E value, the I value, and the CS value are each calculated using Expressions (1) to (5) described in Non-Patent Document 2.

P(i, j) in Expressions (1) to (5) is a gray-level co-occurrence matrix, and the value at the i-th row in the j-th column of the matrix P is expressed as P (i, j). The calculation is performed using the 256×256 matrixes P as described above, and thus in a case where it is desired to emphasize this point, Expressions (1) to (5) can be corrected to Expressions (1') to (5').

Here, L in Expression (2) is the number of grayscale levels (quantization levels of grayscale) that can be taken in the SEM image. In the present embodiment, since the SEM image is output in 256 grayscale levels as described above, L is 256. i and j in Expressions (2) and (3) are natural numbers of 1 to L, and $\mu_x$ and $\mu_y$ in Expression (3) are each represented by Expressions (4) and (5).

In Expressions (1') to (5'), the value at the i-th row in the j-th column of the matrix P is expressed as $P_{ij}$.

$$\text{Entropy} = -\sum_i \sum_j P(i, j) \cdot \log(P(i, j)) \tag{1}$$

$$\text{Inverse difference normalized} = \sum_i \sum_j \frac{P(i, j)}{1 + \frac{|i-j|}{L}} \tag{2}$$

-continued $$\text{Cluster Shade} = \sum_i \sum_j (i + j - \mu_x - \mu_y)^3 P(i, j) \quad (3)$$

$$\mu_x = \sum_i \sum_j i(P(i, j)) \quad (4)$$

$$\mu_y = \sum_i \sum_j j(P(i, j)) \quad (5)$$

$$\text{Entropy} = -\sum_{i=1,j=1}^{i=256,j=256} P_{ij} \log P_{ij} \quad (1')$$

$$\text{Inverse difference normalized} = \sum_{i=1,j=1}^{i=256,j=256} P_{ij} / (1 + |i - j| / 256) \quad (2')$$

$$\text{Cluster Shade} = \sum_{i=1,j=1}^{i=256,j=256} (i + j - \mu_x - \mu_y)^3 P_{ij} \quad (3')$$

$$\mu_x = \sum_{i=1,j=1}^{i=256,j=256} i(P_{ij}) \quad (4')$$

$$\mu_y = \sum_{i=1,j=1}^{i=256,j=256} j(P_{ij}) \quad (5')$$

Standard Deviation of Mn Concentration: 0.60 Mass % or Less

The standard deviation of the Mn concentration at a depth position ¼ of the sheet thickness away from the surface (a region ranging from a depth of ⅛ of the sheet thickness from the surface to a depth of ⅜ of the sheet thickness from the surface) of the hot-rolled steel sheet according to the present embodiment at a center position in the sheet width direction is 0.60 mass % or less. This makes it possible to uniformly disperse the hard phase and makes it possible to prevent the decrease of the linearity of the boundary between the fractured surface and the sheared surface of the end surface after shearing working. The standard deviation of the Mn concentration is preferably 0.55 mass % or less or 0.50 mass % or less, and more preferably 0.47 mass % or less. The value of the lower limit of the standard deviation of the Mn concentration is desirably as small as possible from the viewpoint of suppressing excessively large burrs, but the substantial lower limit is 0.10 mass % due to restrictions in the manufacturing process. The lower limit thereof may be set to 0.20 mass % or 0.28 mass % as necessary.

After a sheet thickness-directional cross section parallel to the rolling direction of the hot-rolled steel sheet is mirror-polished, a depth position ¼ of the sheet thickness away from the surface (a region ranging from a depth of ⅛ of the sheet thickness from the surface to a depth of ⅜ of the sheet thickness from the surface) at a center position in the sheet width direction is measured with an electron probe micro-analyzer (EPMA) to measure the standard deviation of the Mn concentration. As measurement conditions, the acceleration voltage is set to 15 kV, the magnification is set to 5,000 times, and the distribution image of a range that is 20 μm long in the sample rolling direction and 20 μm long in the sample sheet thickness direction is measured. More specifically, the measurement interval is set to 0.1 μm, and the Mn concentrations are measured at 40,000 or more points. Next, the standard deviation is calculated based on the Mn concentrations obtained from all of the measurement points, thereby obtaining the standard deviation of the Mn concentration.

Average Crystal Grain Size of Surface Layer: Less than 3.0 μm

Inside bend cracking can be suppressed in the hot-rolled steel sheet by making the crystal grain size of the surface layer fine. The higher the strength of the hot-rolled steel sheet, the more likely the cracking is to occur from the inside bend during bending (hereinafter, referred to as inside bend cracking). The mechanism of inside bend cracking is presumed as follows. At the time of bending, compressive stress is generated in the inside bend. In the beginning, the working proceeds while the entire inside bend is uniformly deformed; however, as the amount of the working increases, only uniform deformation is no longer sufficient to carry deformation, and the deformation proceeds as strain concentrates locally (generation of a shear deformation band). As this shear deformation band further grows, cracking occurs along the shear band from the surface of the inside bend and propagate. The reason for the inside bend cracking to be more likely to occur in association with high-strengthening is presumed to be that deterioration of work hardening capability in association with high-strengthening makes it difficult for uniform deformation to proceed and makes it easy for bias of deformation to be caused, which generates a shear deformation band in an early stage of the working (or under loose working conditions).

The present inventors found from studies that inside bend cracking becomes significant in steel sheets having a 980 MPa or more-grade tensile strength. In addition, the present inventors found that, as the crystal grain size of the surface layer of the hot-rolled steel sheet becomes finer, local strain concentration is further suppressed, and it becomes more unlikely that inside bend cracking occurs. In order to obtain the above action, the average crystal grain size of the surface layer of the hot-rolled steel sheet is preferably set to less than 3.0 μm. The average crystal grain size of the surface layer is more preferably 2.7 μm or less or 2.5 μm or less. The lower limit of the average crystal grain size of the surface layer region is not particularly specified and may be set to 0.5 μm or 1.0 μm.

In the present embodiment, the surface layer is a region ranging from the surface of the hot-rolled steel sheet to a position at a depth of 50 μm from the surface. As described above, the surface mentioned here refers to the interface between a plating layer and the steel sheet in a case where the hot-rolled steel sheet is provided with the plating layer.

The crystal grain size of the surface layer is measured using an EBSP-OIM (electron back scatter diffraction pattern-orientation image microscopy) method. The EBSP-OIM method is performed using a device obtained by combining a scanning electron microscope and an EBSP analyzer and OIM Analysis (registered trademark) manufactured by AMETEK, Inc. The analyzable area of the EBSP-OIM method is a region that can be observed with the SEM. The EBSP-OIM method makes it possible to analyze a region with a minimum resolution of 20 nm, which varies depending on the resolution of the SEM.

In a region in a cross section parallel to the rolling direction of the hot-rolled steel sheet, ranging from the surface of the hot-rolled steel sheet to a position at a depth of 50 μm from the surface, at a center position in the sheet width direction, analysis is performed in at least 5 visual fields at a magnification of 1,200 times and a region of 40 μm×30 μm. A place where an angle difference between adjacent measurement points is 5° or more is defined as a crystal grain boundary, and an area-averaged crystal grain size is calculated. The obtained area-averaged crystal grain size is regarded as the average crystal grain size of the surface layer.

Residual austenite is not a structure formed by phase transformation at 600° C. or lower and has no dislocation accumulation effect. Accordingly, in the present measurement method (the method of measuring the average crystal grain size of the surface layer), residual austenite is not regarded as a target to be analyzed. In a case where the area ratio of residual austenite is 0%, there is no need to exclude the residual austenite from the target to be analyzed. However, in a case where there is a possibility of affecting the measurement of the average crystal grain size of the surface layer, residual austenite having an fcc crystal structure is excluded for measurement from the target to be analyzed in the EBSP-OIM method.

Tensile Strength Properties

In the hot-rolled steel sheet according to the present embodiment, the tensile strength (TS) is 980 MPa or more. In a case where the tensile strength is less than 980 MPa, an applicable component is limited, and the contribution to vehicle body weight reduction is small. The upper limit does not need to be particularly limited and may be set to 1,780 MPa from the viewpoint of suppressing the wearing of a die.

The tensile strength are evaluated according to JIS Z 2241: 2011 using a No. 5 test piece of JIS Z 2241: 2011. As a position where a tensile test piece is collected, a ¼ portion extending from the end portion in the sheet width direction may be set, and a direction perpendicular to the rolling direction may be set as a longitudinal direction.

Hole Expanding Properties

In the hot-rolled steel sheet according to the present embodiment, the hole expansion rate (λ) is preferably 55% or more. In a case where the hole expansion rate (λ) is 55% or more, it is possible to obtain a hot-rolled steel sheet that greatly contributes to vehicle body weight reduction without limiting applicable components. There is no need to specifically limit the upper limit of the hole expansion rate (λ), and the upper limit may be 85% or 80%.

The hole expansion rate (λ) is measured according to JIS Z 2256: 2010 using a No. 5 test piece of JIS Z 2241: 2011. The sampling position of the hole expansion test piece may be a ¼ portion from the end portion of the hot-rolled steel sheet in the sheet width direction.

Sheet Thickness

The sheet thickness of the hot-rolled steel sheet according to the present embodiment is not particularly limited and may be set to 0.5 to 8.0 mm. In a case where the sheet thickness of the hot-rolled steel sheet is set to less than 0.5 mm, it becomes easy to secure the rolling finishing temperature, the rolling force can be reduced, and thus it is possible to easily perform hot rolling. Therefore, the sheet thickness of the hot-rolled steel sheet according to the present embodiment may be set to 0.5 mm or more. The sheet thickness is preferably 1.2 mm or more, 1.4 mm or more, or 1.8 mm or more. In addition, in a case where the sheet thickness is set to 8.0 mm or less, the micronizing of the microstructure becomes easy, and the above-described microstructure can be easily secured. Therefore, the sheet thickness may be set to 8.0 mm or less. The sheet thickness is preferably 6.0 mm or less, 5.0 mm or less, or 4.0 mm or less.

Plating Layer

The hot-rolled steel sheet according to the present embodiment having the above-described chemical composition and microstructure may be provided with a plating layer on the surface for the purpose of improving corrosion resistance and the like and thereby made into a surface-treated steel sheet. The plating layer may be an electro plating layer or a hot-dip plating layer. As the electro plating layer, electrogalvanizing, electro Zn—Ni alloy plating, and the like are exemplary examples. As the hot-dip plating layer, hot-dip galvanizing, hot-dip galvannealing, hot-dip aluminizing, hot-dip Zn—Al alloy plating, hot-dip Zn—Al—Mg alloy plating, hot-dip Zn—Al—Mg—Si alloy plating, and the like are exemplary examples. The plating adhesion amount is not particularly limited and may be the same as before. In addition, it is also possible to further increase the corrosion resistance by performing an appropriate chemical conversion treatment (for example, application and drying of a silicate-based chromium-free chemical conversion liquid) after plating.

Manufacturing Conditions

A suitable manufacturing method of the hot-rolled steel sheet according to the present embodiment having the above-described chemical composition and microstructure is as follows.

In the suitable manufacturing method of the hot-rolled steel sheet according to the present embodiment, the following steps (1) to (9) are sequentially performed. The temperature of a slab and the temperature of a steel sheet in the present embodiment refer to the surface temperature of the slab and the surface temperature of the steel sheet. In addition, stress refers to tension that is loaded in the rolling direction of the steel sheet.

(1) A slab is held in a temperature range of 700° C. to 850° C. for 900 seconds or longer, then, further heated, and held in a temperature range of 1,100° C. or higher for 6,000 seconds or longer.
(2) Hot rolling is performed so that the sheet thickness is reduced by a total of 90% or more in a temperature range of 850° C. to 1,100° C.
(3) Stress of 170 kPa or more is loaded to the steel sheet after rolling one stage before the final stage of the hot rolling and before the final stage rolling.
(4) The rolling reduction at the final stage of the hot rolling is set to 8% or more, and the hot rolling is finished so that the rolling finishing temperature Tf becomes 900° C. or higher and lower than 960° C.
(5) Stress that is loaded to the steel sheet after the final stage rolling of the hot rolling and until the steel sheet is cooled to 800° C. is set to less than 200 kPa.
(6) The steel sheet is cooled to a temperature range of the hot rolling finishing temperature Tf−50° C. or lower within 1 second after the finishing of the hot rolling, and then accelerated cooling is performed so that an average cooling rate to 600° C. becomes 50° C./s or faster. Here, the cooling to the temperature range of the hot rolling finishing temperature Tf−50° C. or lower within 1 second after the finishing of the hot rolling is a more preferable cooling condition.
(7) Cooling is performed so that the average cooling rate in a temperature range of 450° C. to 600° C. is 30° C./s or faster and slower than 50° C./s.
(8) Cooling is performed so that the average cooling rate in a temperature range of the coiling temperature to 450° C. is 50° C./s or faster.
(9) Coiling is performed in a temperature range of 350° C. or lower.

A hot-rolled steel sheet having excellent hole expansibility and shearing property with high strength and high limit fracture sheet thickness reduction ratio can be stably manufactured by employing the above-described manufacturing method. That is, by appropriately controlling the slab heating conditions and the hot rolling conditions, the reduction of Mn segregation and equiaxed austenite before transformation are achieved, and, in cooperation with the cooling conditions after the hot rolling to be described later, a hot-rolled steel sheet having a desired microstructure can be stably manufactured.

(1) Slab, Slab Temperature when Subjected to Hot Rolling, and Holding Time

As the slab to be subjected to hot rolling, a slab obtained by continuous casting, a slab obtained by casting and blooming, and the like can be used. In addition, a slab obtained by additionally performing hot working or cold working on the above-described slab can be used as necessary.

The slab to be subjected to hot rolling is preferably held in a temperature range of 700° C. to 850° C. for 900 seconds or longer during slab heating, then, further heated, and held in a temperature range of 1,100° C. or higher for 6,000 seconds or longer. During the holding in a temperature range of 700° C. to 850° C., the steel sheet temperature may be fluctuated or be maintained constant in this temperature range. Furthermore, during the holding in a temperature range of 1,100° C. or higher, the steel sheet temperature may be fluctuated or be maintained constant in a temperature range of 1,100° C. or higher.

In austenite transformation at 700° C. to 850° C., Mn is distributed between ferrite and austenite, and Mn can be diffused into the ferrite region by extending the transformation time. Accordingly, the Mn microsegregation unevenly distributed in the slab can be eliminated, and the standard deviation of the Mn concentration can be significantly reduced. Reduction in the standard deviation of the Mn concentration makes it possible to increase the linearity of the boundary between the fractured surface and the sheared surface of the end surface after shearing working. In addition, it is possible to achieve a desired I value.

In addition, in order to reduce the standard deviation of the Mn concentration and achieve a desired I value, the holding time in the temperature range of 1100° C. or higher is preferably set to 6000 seconds or longer. In order to obtain a desired amount of martensite and tempered martensite, the temperature held for 6000 seconds or longer is preferably set to 1100° C. or higher.

In the hot rolling, it is preferable to use a reverse mill or a tandem mill for multi-pass rolling. Particularly, from the viewpoint of industrial productivity, at least the final several stages are more preferably hot rolling in which a tandem mill is used.

(2) Rolling Reduction of Hot Rolling: Sheet Thickness Reduction by Total of 90% or More in Temperature Range of 850° C. to 1,100° C.

By performing hot rolling so that the sheet thickness is reduced by a total of 90% or more in a temperature range of 850° C. to 1,100° C., recrystallized austenite grains are mainly refined, and accumulation of strain energy into unrecrystallized austenite grains is promoted. In addition, the recrystallization of austenite is promoted, and the atomic diffusion of Mn is promoted, which makes it possible to reduce the standard deviation of the Mn concentration. In addition, it is possible to achieve a desired I value. Therefore, it is preferable to perform the hot rolling so that the sheet thickness is reduced by a total of 90% or more in a temperature range of 850° C. to 1,100° C.

The sheet thickness reduction in a temperature range of 850° C. to 1,100° C. can be expressed as $(t_0-t_1)/t_0\times100(\%)$ where to represents an inlet sheet thickness before the first rolling in the rolling in the above temperature range and $t_1$ represents an outlet sheet thickness after the final stage rolling in the rolling in the above temperature range.

(3) Stress after Rolling One Stage Before Final Stage of Hot Rolling and Before Final Stage Rolling: 170 kPa or More The stress that is loaded to the steel sheet after rolling one stage before the final stage of hot rolling and before the final stage rolling is preferably set to 170 kPa or more. This makes it possible to reduce the number of crystal grains having a {h111}<001> crystal orientation in the recrystallized austenite after the rolling one stage before the final stage. Since recrystallization is difficult to occur in the {h110}<001> crystal orientation, recrystallization by the final stage rolling can be effectively promoted by suppressing the formation of this crystal orientation. As a result, the band-like structure of the hot-rolled steel sheet is improved, the periodicity of the microstructure is reduced, and the E value increases. In a case where the stress that is loaded to the steel sheet is less than 170 kPa, it may be impossible to achieve a desired E value. The stress that is loaded to the steel sheet is more preferably 190 kPa or more. The stress that is loaded to the steel sheet can be controlled by adjusting the roll rotation speed during tandem rolling, and can be obtained by dividing the load in the rolling direction measured in a rolling stand by the cross-sectional area of the passing sheet.

(4) Rolling Reduction at Final Stage of Hot Rolling: 8% or More, Hot Rolling Finishing Temperature Tf: 900° C. or Higher and Lower than 960° C.

It is preferable that the rolling reduction at the final stage of the hot rolling is set to 8% or more and the hot rolling finishing temperature Tf is set to 900° C. or higher. By setting the rolling reduction at the final stage of the hot rolling to 8% or more, it is possible to promote recrystallization caused by the final stage rolling. As a result, the band-like structure of the hot-rolled steel sheet is improved, the periodicity of the microstructure is reduced, and the E value increases. By setting the hot rolling finishing temperature Tf to 900° C. or higher, it is possible to suppress an excessive increase in number of ferrite nucleation sites in austenite. As a result, the formation of ferrite in the final structure (the microstructure of the manufactured hot-rolled steel sheet) is suppressed, and a high-strength hot-rolled steel sheet can be obtained. In addition, by setting the hot rolling finishing temperature Tf to lower than 960° C., the coarsening of the austenite grain size can be suppressed, and a desired E value can be obtained due to the reduced periodicity of the microstructure.

(5) Stress after Final Stage Rolling of Hot Rolling and Until Steel Sheet is Cooled to 800° C.: Less than 200 kPa Stress that is loaded to the steel sheet after the final stage rolling of the hot rolling and until the steel sheet is cooled to 800° C. is preferably set to less than 200 kPa. By setting the stress (tension) that is loaded in the rolling direction of the steel sheet to less than 200 kPa, the recrystallization of austenite preferentially proceeds in the rolling direction, and an increase in periodicity of the microstructure can be suppressed. As a result, a desired E value can be obtained. The stress that is loaded to the steel sheet is more preferably 180 kPa or less. The stress that is loaded in the rolling direction of the steel sheet can be controlled by adjusting the rotation speeds of the rolling stand and the coiling device, and can be obtained by dividing the measured load in the rolling direction by the cross-sectional area of the passing sheet.

(6) Accelerated Cooling being Performed so that Average Cooling Rate from Finishing of Hot Rolling to 600° C. Becomes 50° C./s or Faster By performing an accelerated cooling so that the average cooling rate from finishing of hot rolling to 600° C. becomes 50° C./s or faster, the ferrite transformation, bainite transformation and/or perlite transformation inside the steel sheet can be suppressed, and a desired strength can be obtained. In addition, it is possible to achieve a desired I value. In a case where air cooling or the like is performed after finishing of hot rolling and before the accelerated cooling to 600° C. is performed, it is not preferable since the amount of ferrite may increase and the I value may not be the desired value.

The upper limit of the cooling rate is not particularly specified, but in a case where the cooling rate is increased, the cooling equipment becomes large and the equipment cost increases. Therefore, considering the equipment cost, the cooling rate is preferably 300° C./s or slower.

The average cooling rate mentioned here refers to a value obtained by dividing the temperature drop width of the steel sheet from the start of the accelerated cooling (when introducing the steel sheet into cooling equipment) by the time required from the start of the accelerated cooling to the steel sheet temperature reaches 600° C.

In cooling after finishing of hot rolling, it is more preferable to cool to a temperature range of the hot rolling finishing temperature Tf− 50° C. or lower within 1 second after finishing of the hot rolling. That is, it is more preferable that the cooling amount within 1 second after finishing of hot rolling is 50° C. or higher. This is because the growth of austenite crystal grains refined by hot rolling can be suppressed. In order to cool the steel sheet to a temperature range of the hot rolling finishing temperature Tf− 50° C. or lower within 1 second after finishing of hot rolling, cooling may be performed at a fast average cooling rate immediately after the finishing of the hot rolling. For example, cooling water may be sprayed to the surface of the steel sheet. By cooling the steel sheet to a temperature range of Tf− 50° C. or lower within 1 second after the finishing of the hot rolling, it is possible to refine the crystal grain size of the surface layer and to increase the inside bend cracking resistance of the hot-rolled steel sheet.

After the steel sheet is cooled to the temperature range of the hot rolling finishing temperature Tf− 50° C. or within 1 second after finishing of hot rolling, as described above, it is preferable to perform accelerated cooling so that the average cooling rate to 600° C. becomes 50° C./s or faster.

(7) Cooling being Performed so that Average Cooling Rate in Temperature Range of 450° C. to 600° C. is 30° C./s or Faster and Slower than 50° C./s After the end of the accelerated cooling, it is preferable to perform cooling so that the average cooling rate in a temperature range of 450° C. to 600° C. is 30° C./s or faster and slower than 50° C./s. By setting the average cooling rate in the temperature range to 30° C./s or faster and slower than 50° C./s, a desired CS value can be obtained. In a case where the average cooling rate is faster than 50° C./s, coarse crystal grains is likely to be formed in the microstructure, and the CS value becomes less than $-8.0\times10^5$. In a case where the average cooling rate is slower than 30° C./s, the strength of the hard structure increases, and the difference in strength from the soft structure increases. Therefore, the CS value becomes more than $8.0\times10^5$.

The average cooling rate mentioned here refers to a value obtained by dividing the temperature drop width of the steel sheet from the cooling stop temperature of the accelerated cooling where the average cooling rate is 50° C./s or faster to the cooling stop temperature of the cooling where the average cooling rate is 30° C./s or faster and slower than 50° C./s by the time required from the stop of the accelerated cooling where the average cooling rate is s 50° C./s or faster to the stop of the cooling where the average cooling rate is 30° C./s or faster and slower than 50° C./s.

(8) Average Cooling Rate in Temperature Range of Coiling Temperature to 450° C.: 50° C./s or Faster In order to suppress the area ratio of pearlite and obtain a desired strength, the average cooling rate in a temperature range of the coiling temperature to 450° C. is preferably set to 50° C./s or faster. In such a case, the primary phase structure can be made hard.

The average cooling rate mentioned here refers to a value obtained by dividing the temperature drop width of the steel sheet from the cooling stop temperature of the cooling where the average cooling rate is 30° C./s or faster and slower than 50° C./s to the coiling temperature by the time required from the stop of the cooling where the average cooling rate is 30° C./s or faster and slower than 50° C./s to the coiling.

(9) Coiling Temperature: 350° C. or Lower

The coiling temperature is preferably set to 350° C. or lower. In a case where the coiling temperature is set to 350° C. or lower, it is possible to increase the transformation driving force from austenite to bcc and it is also possible to increase the deformation strength of austenite. Therefore, when austenite transforms into martensite, the hard phase is uniformly distributed, and variation can be improved. As a result, it is possible to reduce the I value and to increase the linearity of the boundary between the fractured surface and the sheared surface of the end surface after shearing working. Therefore, the coiling temperature is preferably set to 350° C. or lower.

EXAMPLES

Next, the effects of one aspect of the present invention will be described in more detail using examples. However, conditions in the examples are merely exemplary to confirm the feasibility and the effects of the present invention, and the present invention is not limited to these condition examples. The present invention may employ various conditions to achieve the object of the present invention without departing from the gist of the present invention.

Steels having a chemical composition shown in Tables 1 and 2 were melted and continuously cast to manufacture slabs having a thickness of 240 to 300 mm. The obtained slabs were used to obtain hot-rolled steel sheets shown in Tables 5 and 6 under the manufacturing conditions shown in Tables 3 and 4.

In manufacturing No. 11, air cooling was performed for 5.0 seconds after cooling to 791° C. from finishing of hot rolling. The average cooling rate of air cooling was slower than 5° C./s.

The area ratio of the microstructure, the E value, the I value, the CS value, the standard deviation of the Mn concentration, the average crystal grain size of the surface layer, the tensile strength (TS), and the hole expansion rate (λ) of each of the obtained hot-rolled steel sheets were obtained by the above methods. The obtained measurement results are shown in Tables 5 and 6.

The remainder in microstructure was one or two of bainite and pearlite.

Methods of Evaluating Properties of Hot-Rolled Steel Sheets

Tensile Strength

In a case where the tensile strength (TS) was 980 MPa or more, the hot-rolled steel sheet was considered to have a high strength, and determined as acceptable. Meanwhile, in a case where the tensile strength (TS) was less than 980 MPa, the hot-rolled steel sheet was not considered to have a high strength, and determined as unacceptable.

Hole Expansion Rate

In a case where the hole expansion rate (λ) is 55% or more, the hot-rolled steel sheet was considered to be excellent in hole expansibility, and determined as acceptable. Meanwhile, in a case where the hole expansion rate (λ) is less than 55%, the hot-rolled steel sheet was considered to be poor in hole expansibility, and determined as unacceptable.

Limit Fracture Sheet Thickness Reduction Ratio

The limit fracture sheet thickness reduction ratio of the hot-rolled steel sheet was evaluated by a tensile test.

The tensile test was performed by the same method as in the evaluation of the tensile properties. The value of (t1−t2)×100/t1 was calculated, where t1 represents the sheet thickness before the tensile test and t2 represents the minimum value of the sheet thickness at a center portion in the width direction of the tensile test piece after fracture, to obtain the limit fracture sheet thickness reduction ratio. In order to obtain the limit fracture sheet thickness reduction ratio, the tensile test was performed five times, and the average value was calculated by taking the mean of three values, excluding the maximum limit fracture sheet thickness reduction ratio and the minimum limit fracture sheet thickness reduction ratio.

In a case where the limit fracture sheet thickness reduction ratio was 75.0% or more, the hot-rolled steel sheet was considered to have a high limit fracture sheet thickness reduction ratio, and determined as acceptable. Meanwhile, in a case where the limit fracture sheet thickness reduction ratio was less than 75.0%, the hot-rolled steel sheet was not considered to have a high limit fracture sheet thickness reduction ratio, and determined as unacceptable.

Shearing Property (Evaluation of Linearity of Boundary Between Fractured Surface and Sheared Surface)

Among the shearing property of the hot-rolled steel sheet, the linearity of the boundary between the fractured surface and the sheared surface was evaluated by obtaining the straightness at the boundary between the fractured surface and the sheared surface by a punching test.

At the sheet width center position of the hot-rolled steel sheet, five punched holes were produced with a hole diameter of 10 mm, a clearance of 15%, and a punching speed of 3 m/s. Next, the appearances of 10 end surfaces parallel to the rolling direction (2 end surfaces per 1 punched hole) were photographed with an optical microscope in the 5 punched holes. In the obtained observation photographs, end surfaces as shown in FIG. 1(*a*) could be observed. As shown in FIGS. 1(*a*) and 1(*b*), a shear droop, a sheared surface, a fractured surface, and a burr are observed on the end surface after punching. FIG. 1(*a*) is a schematic view of the end surface parallel to the rolling direction of the punched hole, and FIG. 1(*b*) is a schematic view of the side surface of the punched hole. The shear droop is an R-like smooth surface, the sheared surface is a punched end surface separated by shear deformation, the fractured surface is a punched end surface separated by a crack initiated from the vicinity of the cutting edge after the end of shear deformation, and the burr is a surface having projections protruding from the lower surface of the hot-rolled steel sheet.

In the observation photographs of the 10 end surfaces obtained from the 5 end surfaces, the straightness at the boundary between the fractured surface and the sheared surface was measured by a method to be described below, and the absolute maximum value of the obtained straightness was calculated.

The straightness at the boundary between the fractured surface and the sheared surface was obtained by the following method.

As shown in FIG. 1(*b*), points (point A and point B in FIG. 1(*b*)) in the boundary between the sheared surface and the fractured surface were determined with respect to the end surface. The length of the distance x between these points A and B connected with a straight line was measured. Next, the length y of the curve along the fractured surface-sheared surface boundary was measured. A value obtained by dividing the obtained y by x was regarded as the straightness at the boundary between the fractured surface and the sheared surface.

In a case where the absolute maximum value of the obtained straightness by the punching test was less than 1.045, the hot-rolled steel sheet was considered to be excellent shearing property and determined as acceptable. Meanwhile, in a case where the absolute maximum value of the obtained straightness was 1.045 or more, the hot-rolled steel sheet was not considered to be excellent shearing property and determined as unacceptable.

Inside Bend Cracking Resistance

A bending test piece, 100 mm×30 mm strip-shaped test piece was cut out from a ½ position in the width direction of the hot-rolled steel sheet, and the inside bend cracking resistance was evaluated by the following bending test.

A test was performed according to the V-block method of JIS Z 2248: 2006 (the bending angle θ is 90°) for both bending where the bending ridge was parallel to the rolling direction (L direction) (L-axis bending) and bending where the bending ridge was parallel to a direction perpendicular to the rolling direction (C direction) (C-axis bending). As a result, a minimum bend radius at which no cracking would occur was obtained, and the inside bend cracking resistance was investigated. A value obtained by dividing the average value of the minimum bend radii in the L axis and in the C axis by the sheet thickness was regarded as the limit bending R/t and used as an index value of inside bend cracking resistance. In a case where R/t was 3.0 or less, the hot-rolled steel sheet was determined to be excellent in inside bend cracking resistance.

Here, regarding the presence or absence of cracks, a cross section obtained by cutting the test piece after the test on a surface parallel to the bending direction and perpendicular to the sheet surface was mirror-polished, cracks were then observed with an optical microscope, and a case where the lengths of cracks observed in the inside bend of the test piece exceeded 30 μm was determined as cracks being present.

TABLE 1

| | Mass %, Remainder Consists of Fe and Impurities | | | | | | | | | | | |
|---|---|---|---|---|---|---|---|---|---|---|---|---|
| Steel No. | C | Si | Mn | sol. Al | P | S | N | O | Ti | Nb | V | Remarks |
| A | 0.120 | 0.30 | 2.88 | 0.050 | 0.001 | 0.0018 | 0.0650 | 0.0079 | | | | Present Invention Steel |
| B | 0.090 | 1.20 | 2.60 | 0.200 | 0.002 | 0.0011 | 0.0700 | 0.0021 | | | | Present Invention Steel |
| C | 0.220 | 0.10 | 2.80 | 0.350 | 0.002 | 0.0011 | 0.0620 | 0.0037 | | | | Present Invention Steel |
| D | 0.195 | 0.07 | 2.20 | 0.009 | 0.000 | 0.0024 | 0.0045 | 0.0044 | | | | Present Invention Steel |
| E | 0.220 | 0.28 | 2.11 | 0.002 | 0.003 | 0.0015 | 0.0180 | 0.0025 | | | | Present Invention Steel |
| F | 0.063 | 1.43 | 3.33 | 0.129 | 0.003 | 0.0017 | 0.0105 | 0.0046 | 0.055 | | | Present Invention Steel |
| G | 0.147 | 2.64 | 2.36 | 0.197 | 0.001 | 0.0003 | 0.0208 | 0.0036 | | 0.045 | | Present Invention Steel |
| H | 0.144 | 0.13 | 3.87 | 0.462 | 0.001 | 0.0028 | 0.0155 | 0.0004 | | | | Present Invention Steel |

TABLE 1-continued

| Steel No. | C | Si | Mn | sol. Al | P | S | N | O | Ti | Nb | V | Remarks |
|---|---|---|---|---|---|---|---|---|---|---|---|---|
| | Mass %, Remainder Consists of Fe and Impurities | | | | | | | | | | | |
| I | 0.049 | 2.47 | 3.18 | 0.271 | 0.003 | 0.0013 | 0.0093 | 0.0047 | | | 0.223 | Present Invention Steel |
| J | 0.061 | 1.26 | 2.21 | 0.186 | 0.000 | 0.0186 | 0.0290 | 0.0022 | | | 0.056 | Present Invention Steel |
| K | 0.065 | 1.40 | 2.63 | 0.162 | 0.000 | 0.0017 | 0.0298 | 0.0044 | | 0.082 | | Present Invention Steel |
| L | 0.149 | 0.23 | 1.95 | 0.128 | 0.001 | 0.0001 | 0.0203 | 0.0027 | 0.110 | 0.062 | 0.417 | Present Invention Steel |
| M | 0.056 | 0.36 | 2.51 | 0.199 | 0.001 | 0.0024 | 0.0255 | 0.0028 | | | 0.087 | Present Invention Steel |
| N | 0.086 | 0.12 | 2.96 | 0.186 | 0.001 | 0.0009 | 0.0255 | 0.0002 | 0.039 | | | Present Invention Steel |
| O | 0.149 | 0.14 | 2.47 | 0.144 | 0.000 | 0.0005 | 0.0194 | 0.0040 | | 0.089 | | Present Invention Steel |
| P | 0.140 | 0.08 | 2.55 | 0.198 | 0.001 | 0.0005 | 0.0252 | 0.0017 | 0.126 | | | Present Invention Steel |
| Q | 0.023 | 2.42 | 2.89 | 0.139 | 0.003 | 0.0028 | 0.0019 | 0.0034 | | | | Comparative Steel |
| R | 0.263 | 1.82 | 2.48 | 0.140 | 0.001 | 0.0027 | 0.0272 | 0.0046 | | | | Comparative Steel |
| S | 0.124 | 0.03 | 2.98 | 0.324 | 0.002 | 0.0023 | 0.015 | 0.0022 | | 0.008 | | Comparative Steel |
| T | 0.133 | 3.09 | 3.11 | 0.112 | 0.003 | 0.0030 | 0.0120 | 0.0035 | 0.008 | | | Comparative Steel |
| U | 0.135 | 1.68 | 0.92 | 0.151 | 0.003 | 0.0006 | 0.0108 | 0.0005 | | | 0.022 | Comparative Steel |
| V | 0.072 | 0.13 | 4.13 | 0.112 | 0.002 | 0.0006 | 0.0176 | 0.0038 | | | 0.024 | Comparative Steel |
| W | 0.125 | 1.80 | 1.63 | 0.176 | 0.001 | 0.0022 | 0.0103 | 0.0027 | | | | Present Invention Steel |
| X | 0.111 | 0.98 | 1.92 | 0.151 | 0.039 | 0.0003 | 0.0106 | 0.0005 | | | | Present Invention Steel |
| Y | 0.146 | 0.88 | 2.20 | 0.113 | 0.002 | 0.0120 | 0.0128 | 0.0038 | | | | Present Invention Steel |
| Z | 0.072 | 0.120 | 2.13 | 0.099 | 0.002 | 0.0009 | 0.0930 | 0.0038 | | | | Present Invention Steel |

The underline indicates that the corresponding value is outside the range of the present invention.

TABLE 2

| Steel No. | Cu | Cr | Mo | Ni | B | Ca | Mg | REM | Bi | As | Zr | Co | Zn | W | Sn | Zr+Co+Zn+W | Remarks |
|---|---|---|---|---|---|---|---|---|---|---|---|---|---|---|---|---|---|
| | Mass %, Remainder Consists of Te and Impurities | | | | | | | | | | | | | | | | |
| A | | | | | | | | | | | | | | | | | Present Invention Steel |
| B | | | | | | | | | | | | | | | | | Present Invention Steel |
| C | | | | | | 0.0170 | 0.0050 | | | | | | | | | | Present Invention Steel |
| D | | | | | | | | | 0.013 | | | | | | | | Present Invention Steel |
| E | | | | | | | | | | | | | | | | | Present Invention Steel |
| F | | | | | | | | | | | | | 0.37 | | | 0.37 | Present Invention Steel |
| G | | | | | 0.0080 | | | | | | | | | | | | Present Invention Steel |
| H | | | | | | | | | | | | | | | 0.02 | | Present Invention Steel |
| I | | | | | | | | | | | | | | | | | Present Invention Steel |
| J | | | | | | | | 0.0600 | | | | | | | | | Present Invention Steel |
| K | | | | | | | | | | | | | | 0.05 | | 0.05 | Present Invention Steel |
| L | | | | | | | | | | | 0.22 | | | | | 0.22 | Present Invention Steel |
| M | 1.13 | | | | | | | | | | | 0.24 | | | | 0.24 | Present Invention Steel |
| N | | 1.30 | | | 0.0050 | | | | | | | | | | | | Present Invention Steel |
| O | | | 0.04 | | | | | | | | | | | | 0.04 | | Present Invention Steel |
| P | | | | 0.36 | | | | | | | | | | | | | Present Invention Steel |
| Q | | | | | | | | | | | | | | | | | Comparative Steel |
| R | | | | | | | | | | | | | | | | | Comparative Steel |
| S | | | | | | | | | | | | | | | | | Comparative Steel |
| T | | | | | | | | | | | | | | | | | Comparative Steel |

TABLE 2-continued

| Steel No. | Mass %, Remainder Consists of Te and Impurities | | | | | | | | | | | | | | | | Remarks |
|---|---|---|---|---|---|---|---|---|---|---|---|---|---|---|---|---|---|
| | Cu | Cr | Mo | Ni | B | Ca | Mg | REM | Bi | As | Zr | Co | Zn | W | Sn | Zr+Co+Zn+W | |
| U | | | | | | | | | | | | | | | | | Comparative Steel |
| V | | | | | | | | | | | | | | | | | Comparative Steel |
| W | | | | | | | | | | | | | | | | | Present Invention Steel |
| X | | | | | | | | | | | | | | | | | Present Invention Steel |
| Y | | | | | | | | | | 0.062 | | | | | | | Present Invention Steel |
| Z | | | | | | | | | | | | | | | | | Present Invention Steel |

TABLE 3

| Manufacturing No. | Steel No. | Holding Time in Temperature Range of 700° C. to 850° C. s | Heating Temperature ° C. | Holding Time in Temperature Range of 1,100° C. or Higher s | Sheet Thickness Reduction at 850° C. to 1,100° C. % | Loaded Stress After Rolling One Stage Before Final Stage and Before Final Stage Rolling kPa | Hot Rolling Finishing Temperature Tf ° C. | Rolling Reduction at Final Stage % | Loaded Stress After Final Stage Rolling of Hot Rolling and Until Steel Sheet is Cooled to 800° C. kPa | Remarks |
|---|---|---|---|---|---|---|---|---|---|---|
| 1 | A | 1117 | 1143 | 6210 | 94 | 211 | 952 | 17 | 192 | Present Invention Example |
| 2 | B | 977 | 1102 | 6222 | 96 | 208 | 933 | 16 | 191 | Present Invention Example |
| 3 | B | 836 | 1190 | 6195 | 94 | 210 | 931 | 16 | 194 | Comparative Example |
| 4 | B | 926 | 1184 | 6210 | 87 | 210 | 940 | 15 | 193 | Comparative Example |
| 5 | B | 920 | 1182 | 5511 | 96 | 212 | 935 | 16 | 195 | Comparative Example |
| 6 | B | 1256 | 1188 | 6184 | 95 | 168 | 932 | 16 | 190 | Comparative Example |
| 7 | B | 1085 | 1200 | 6231 | 96 | 213 | 1014 | 17 | 192 | Comparative Example |
| 8 | B | 1157 | 1182 | 6211 | 93 | 211 | 932 | 6 | 193 | Comparative Example |
| 9 | B | 1172 | 1181 | 6228 | 95 | 213 | 932 | 16 | 215 | Comparative Example |
| 10 | B | 968 | 1196 | 6193 | 95 | 199 | 934 | 17 | 191 | Present Invention Example |
| 11 | B | 1037 | 1193 | 6206 | 96 | 210 | 933 | 15 | 194 | Comparative Example |
| 12 | B | 1033 | 1195 | 6210 | 97 | 201 | 933 | 16 | 193 | Present Invention Example |
| 13 | B | 1209 | 1193 | 6226 | 94 | 211 | 953 | 16 | 192 | Comparative Example |
| 14 | B | 1309 | 1184 | 6232 | 95 | 211 | 930 | 16 | 190 | Comparative Example |
| 15 | B | 1338 | 1187 | 6219 | 95 | 211 | 932 | 16 | 192 | Comparative Example |
| 16 | B | 1212 | 1190 | 6870 | 96 | 208 | 948 | 17 | 192 | Comparative Example |
| 17 | B | 936 | 1188 | 6226 | 97 | 212 | 933 | 15 | 193 | Comparative Example |
| 18 | C | 902 | 1181 | 6010 | 91 | 213 | 904 | 14 | 192 | Present Invention Example |
| 19 | D | 969 | 1223 | 6206 | 96 | 212 | 902 | 23 | 194 | Present Invention Example |
| 20 | E | 937 | 1192 | 6193 | 97 | 212 | 931 | 9 | 194 | Present Invention Example |
| 21 | F | 1063 | 1116 | 7287 | 96 | 211 | 906 | 16 | 194 | Present Invention Example |
| 22 | G | 970 | 1103 | 6216 | 94 | 201 | 931 | 15 | 193 | Present Invention Example |
| 23 | H | 1058 | 1229 | 7836 | 96 | 213 | 905 | 17 | 193 | Present Invention Example |
| 24 | I | 974 | 1108 | 6219 | 97 | 213 | 934 | 16 | 193 | Present Invention Example |
| 25 | J | 953 | 1194 | 6184 | 95 | 211 | 942 | 16 | 192 | Present Invention Example |
| 26 | K | 991 | 1186 | 6220 | 94 | 211 | 931 | 16 | 195 | Present Invention Example |
| 27 | L | 1044 | 1191 | 6193 | 93 | 195 | 935 | 16 | 182 | Present Invention Example |
| 28 | M | 965 | 1184 | 6226 | 94 | 211 | 930 | 16 | 193 | Present Invention Example |
| 29 | N | 978 | 1199 | 6208 | 94 | 213 | 930 | 15 | 193 | Present Invention Example |
| 30 | O | 1074 | 1148 | 6238 | 95 | 211 | 931 | 16 | 191 | Present Invention Example |
| 31 | P | 917 | 1192 | 6206 | 97 | 212 | 940 | 16 | 190 | Present Invention Example |
| 32 | Q | 980 | 1108 | 6210 | 95 | 202 | 934 | 15 | 192 | Comparative Example |
| 33 | R | 936 | 1181 | 6184 | 93 | 210 | 931 | 16 | 193 | Comparative Example |
| 34 | S | 976 | 1196 | 6214 | 93 | 212 | 951 | 17 | 194 | Comparative Example |
| 35 | T | 996 | 1227 | 6211 | 96 | 231 | 934 | 16 | 193 | Comparative Example |
| 36 | U | 923 | 1147 | 6186 | 94 | 213 | 933 | 16 | 193 | Comparative Example |
| 37 | V | 1096 | 1170 | 6208 | 97 | 211 | 934 | 15 | 194 | Comparative Example |

TABLE 3-continued

| Manufacturing No. | Steel No. | Holding Time in Temperature Range of 700° C. to 850° C. s | Heating Temperature ° C. | Holding Time in Temperature Range of 1,100° C. or Higher s | Sheet Thickness Reduction at 850° C. to 1,100° C. % | Loaded Stress After Rolling One Stage Before Final Stage and Before Final Stage Rolling kPa | Hot Rolling Finishing Temperature Tf ° C. | Rolling Reduction at Final Stage % | Loaded Stress After Final Stage Rolling of Hot Rolling and Until Steel Sheet is Cooled to 800° C. kPa | Remarks |
|---|---|---|---|---|---|---|---|---|---|---|
| 38 | W | 981 | 1166 | 6140 | 97 | 208 | 954 | 17 | 194 | Present Invention Example |
| 39 | X | 1015 | 1144 | 6175 | 92 | 207 | 924 | 16 | 191 | Present Invention Example |
| 40 | Y | 994 | 1156 | 6392 | 97 | 213 | 913 | 15 | 195 | Present Invention Example |
| 41 | Z | 984 | 1140 | 6095 | 91 | 217 | 928 | 16 | 192 | Present Invention Example |

The underline indicates that the corresponding condition is not a preferable manufacturing condition.

TABLE 4

| Manufacturing No. | Steel No. | Cooling Amount within 1 Second After Finishing of Hot Rolling ° C. | Average Cooling Rate From Finishing of Hot Rolling to 600° C. ° C./s | Starting Temperature of Air Cooling ° C. | Air Cooling Time s | Average Cooling Rate in Temperature Range of 450° C. to 600° C. ° C./s | Average Cooling Rate in Temperature Range of Coiling Temperature to 450° C. ° C./s | Coiling Temperature ° C. | Remarks |
|---|---|---|---|---|---|---|---|---|---|
| 1 | A | 57 | 113 | | | 43 | 54 | 86 | Present Invention Example |
| 2 | B | 55 | 111 | | | 42 | 54 | 54 | Present Invention Example |
| 3 | B | 58 | 111 | | | 41 | 56 | 61 | Comparative Example |
| 4 | B | 56 | 111 | | | 44 | 63 | 84 | Comparative Example |
| 5 | B | 55 | 107 | | | 46 | 59 | 66 | Comparative Example |
| 6 | B | 56 | 107 | | | 42 | 57 | 84 | Comparative Example |
| 7 | B | 56 | 110 | | | 40 | 55 | 74 | Comparative Example |
| 8 | B | 60 | 112 | | | 41 | 59 | 60 | Comparative Example |
| 9 | B | 56 | 110 | | | 43 | 56 | 52 | Comparative Example |
| 10 | B | 55 | 114 | | | 43 | 65 | 63 | Present Invention Example |
| 11 | B | 55 | 113 | 791 | 5.0 | 43 | 56 | 78 | Comparative Example |
| 12 | B | 42 | 108 | | | 43 | 59 | 83 | Present Invention Example |
| 13 | B | 56 | 39 | | | 44 | 56 | 69 | Comparative Example |
| 14 | B | 57 | 112 | | | 61 | 56 | 64 | Comparative Example |
| 15 | B | 56 | 114 | | | 22 | 54 | 71 | Comparative Example |
| 16 | B | 53 | 94 | | | 39 | 58 | 358 | Comparative Example |
| 17 | B | 56 | 106 | | | 40 | 33 | 53 | Comparative Example |
| 18 | C | 55 | 65 | | | 43 | 56 | 84 | Present Invention Example |
| 19 | D | 56 | 162 | | | 42 | 78 | 84 | Present Invention Example |
| 20 | E | 57 | 107 | | | 45 | 51 | 66 | Present Invention Example |
| 21 | F | 61 | 109 | | | 43 | 55 | 60 | Present Invention Example |
| 22 | G | 56 | 108 | | | 41 | 54 | 298 | Present Invention Example |
| 23 | H | 57 | 55 | | | 35 | 51 | 82 | Present Invention Example |
| 24 | I | 56 | 107 | | | 42 | 54 | 86 | Present Invention Example |
| 25 | J | 56 | 115 | | | 42 | 57 | 103 | Present Invention Example |
| 26 | K | 56 | 112 | | | 41 | 50 | 73 | Present Invention Example |
| 27 | L | 59 | 108 | | | 42 | 56 | 81 | Present Invention Example |
| 28 | M | 57 | 106 | | | 43 | 56 | 45 | Present Invention Example |
| 29 | N | 56 | 108 | | | 43 | 53 | 57 | Present Invention Example |
| 30 | O | 55 | 92 | | | 42 | 55 | 39 | Present Invention Example |
| 31 | P | 56 | 112 | | | 44 | 56 | 83 | Present Invention Example |
| 32 | Q | 55 | 107 | | | 43 | 55 | 87 | Comparative Example |
| 33 | R | 56 | 112 | | | 42 | 60 | 82 | Comparative Example |
| 34 | S | 54 | 109 | | | 44 | 55 | 66 | Comparative Example |
| 35 | T | 57 | 90 | | | 47 | 54 | 59 | Comparative Example |
| 36 | U | 56 | 114 | | | 42 | 54 | 71 | Comparative Example |
| 37 | V | 56 | 110 | | | 43 | 58 | 83 | Comparative Example |

TABLE 4-continued

| Manufacturing No. | Steel No. | Cooling Amount within 1 Second After Finishing of Hot Rolling ° C. | Average Cooling Rate From Finishing of Hot Rolling to 600° C. ° C./s | Starting Temperature of Air Cooling ° C. | Air Cooling Time s | Average Cooling Rate in Temperature Range of 450° C. to 600° C. ° C./s | Average Cooling Rate in Temperature Range of Coiling Temperature to 450° C. ° C./s | Coiling Temperature ° C. | Remarks |
|---|---|---|---|---|---|---|---|---|---|
| 38 | W | 55 | 108 | | | 43 | 58 | 78 | Present Invention Example |
| 39 | X | 59 | 111 | | | 42 | 55 | 90 | Present Invention Example |
| 40 | Y | 60 | 120 | | | 42 | 53 | 101 | Present Invention Example |
| 41 | Z | 54 | 109 | | | 41 | 52 | 95 | Present Invention Example |

The underline indicates that the corresponding condition is not a preferable manufacturing condition.

TABLE 5

| Manufacturing No. | Steel No. | Sheet Thickness mm | Ferrite area % | Residual Austenite area % | Martensite and Tempered Martensite area % | Remainder in Microstructure area % | E Value – | I Value – | CS Value $\times 10^5$ | Mn Standard Deviation mass % | Average Crystal Grain Size of Surface Layer μm | Remarks |
|---|---|---|---|---|---|---|---|---|---|---|---|---|
| 1 | A | 2.6 | 2.7 | 1.0 | 92.9 | 3.4 | 11.5 | 1.018 | 6.0 | 0.49 | 2.3 | Present Invention Example |
| 2 | B | 2.9 | 0.8 | 1.1 | 97.6 | 0.5 | 11.6 | 1.013 | 2.1 | 0.48 | 2.4 | Present Invention Example |
| 3 | B | 2.9 | 2.7 | 1.3 | 93.6 | 2.4 | 11.6 | 1.036 | −6.0 | 0.66 | 2.4 | Comparative Example |
| 4 | B | 2.9 | 2.7 | 1.2 | 95.7 | 0.4 | 11.6 | 1.028 | −5.0 | 0.75 | 2.1 | Comparative Example |
| 5 | B | 2.9 | 2.6 | 1.1 | 95.4 | 0.9 | 11.5 | 1.035 | 7.4 | 0.68 | 2.2 | Comparative Example |
| 6 | B | 2.9 | 2.7 | 1.0 | 95.1 | 1.3 | 10.4 | 1.013 | 3.2 | 0.43 | 2.3 | Comparative Example |
| 7 | B | 2.9 | 2.7 | 1.1 | 94.2 | 2.0 | 10.3 | 1.012 | −3.5 | 0.49 | 2.2 | Comparative Example |
| 8 | B | 2.9 | 2.9 | 1.2 | 94.6 | 1.2 | 10.7 | 1.013 | 0.5 | 0.45 | 2.3 | Comparative Example |
| 9 | B | 2.9 | 2.8 | 1.2 | 94.3 | 1.7 | 10.2 | 1.013 | −0.6 | 0.48 | 2.2 | Comparative Example |
| 10 | B | 2.9 | 2.7 | 1.0 | 95.2 | 1.1 | 11.5 | 1.013 | −6.6 | 0.48 | 2.5 | Present Invention Example |
| 11 | B | 2.9 | 5.4 | 1.2 | 92.1 | 1.2 | 11.5 | 1.023 | −4.2 | 0.48 | 2.1 | Comparative Example |
| 12 | B | 2.9 | 3.6 | 1.0 | 92.3 | 3.1 | 11.5 | 1.014 | 7.4 | 0.46 | 3.1 | Present Invention Example |
| 13 | B | 2.9 | 3.9 | 1.1 | 92.1 | 2.9 | 11.4 | 1.024 | 5.6 | 0.43 | 2.3 | Comparative Example |
| 14 | B | 2.9 | 2.8 | 1.3 | 95.4 | 0.5 | 11.4 | 1.013 | −10.5 | 0.46 | 2.0 | Comparative Example |
| 15 | B | 2.9 | 2.9 | 1.2 | 93.7 | 2.3 | 11.7 | 1.013 | 11.8 | 0.44 | 2.0 | Comparative Example |
| 16 | B | 2.9 | 2.7 | 1.2 | 92.1 | 4.0 | 11.3 | 1.022 | 7.7 | 0.47 | 2.1 | Comparative Example |
| 17 | B | 2.9 | 2.9 | 3.1 | 90.0 | 4.0 | 11.6 | 1.012 | 1.0 | 0.55 | 3.5 | Comparative Example |
| 18 | C | 2.6 | 2.9 | 1.0 | 94.4 | 1.7 | 11.6 | 1.013 | −1.1 | 0.46 | 2.4 | Present Invention Example |
| 19 | D | 2.5 | 2.8 | 1.1 | 92.3 | 3.9 | 11.6 | 1.012 | −3.2 | 0.41 | 2.1 | Present Invention Example |
| 20 | F | 2.6 | 2.7 | 2.6 | 93.5 | 1.2 | 11.7 | 1.012 | 6.8 | 0.42 | 2.2 | Present Invention Example |
| 21 | F | 1.5 | 2.6 | 1.1 | 95.7 | 0.6 | 11.4 | 1.018 | 6.7 | 0.50 | 2.0 | Present Invention Example |
| 22 | G | 2.6 | 2.6 | 1.2 | 95.1 | 1.0 | 11.6 | 1.015 | −4.5 | 0.47 | 2.1 | Present Invention Example |
| 23 | H | 5.4 | 1.7 | 1.1 | 96.7 | 0.5 | 11.6 | 1.012 | −3.9 | 0.31 | 2.4 | Present Invention Example |
| 24 | I | 2.9 | 2.8 | 1.1 | 95.7 | 0.4 | 11.1 | 1.012 | −7.0 | 0.50 | 2.3 | Present Invention Example |
| 25 | J | 2.9 | 2.6 | 1.2 | 95.0 | 1.3 | 11.5 | 1.013 | 6.3 | 0.46 | 2.1 | Present Invention Example |
| 26 | K | 2.9 | 2.7 | 2.2 | 92.3 | 2.8 | 11.6 | 1.018 | −3.9 | 0.52 | 2.5 | Present Invention Example |
| 27 | L | 2.9 | 2.8 | 1.3 | 94.5 | 1.5 | 11.6 | 1.012 | −0.9 | 0.45 | 2.2 | Present Invention Example |
| 28 | M | 2.7 | 2.8 | 1.2 | 94.8 | 1.2 | 11.4 | 1.012 | −6.5 | 0.38 | 2.1 | Present Invention Example |
| 29 | N | 2.9 | 2.8 | 1.2 | 95.3 | 0.7 | 11.6 | 1.012 | −4.4 | 0.42 | 2.0 | Present Invention Example |
| 30 | O | 2.8 | 2.6 | 1.3 | 95.5 | 0.6 | 11.6 | 1.012 | 5.5 | 0.29 | 2.2 | Present Invention Example |
| 31 | P | 2.9 | 2.6 | 1.1 | 94.5 | 1.7 | 11.7 | 1.013 | −3.6 | 0.33 | 2.5 | Present Invention Example |
| 32 | Q | 2.9 | 5.7 | 1.2 | 92.9 | 0.2 | 11.4 | 1.004 | −1.1 | 0.45 | 2.2 | Comparative Example |
| 33 | R | 2.7 | 1.1 | 1.1 | 91.2 | 6.6 | 10.2 | 1.019 | 2.8 | 0.28 | 2.3 | Comparative Example |
| 34 | S | 2.8 | 0.9 | 1.6 | 92.1 | 5.4 | 11.2 | 1.021 | −0.4 | 0.29 | 2.4 | Comparative Example |
| 35 | T | 2.9 | 4.8 | 1.2 | 92.2 | 1.8 | 10.8 | 1.012 | −6.4 | 0.38 | 2.1 | Comparative Example |
| 36 | U | 2.9 | 2.2 | 1.1 | 96.0 | 0.7 | 11.5 | 1.012 | −0.7 | 0.13 | 2.4 | Comparative Example |
| 37 | V | 2.7 | 1.2 | 3.8 | 94.3 | 0.7 | 11.7 | 1.023 | −3.9 | 0.58 | 4.8 | Comparative Example |
| 38 | W | 2.8 | 1.6 | 1.9 | 93.4 | 3.1 | 11.6 | 1.011 | 0.3 | 0.22 | 2.5 | Present Invention Example |
| 39 | X | 2.7 | 4.0 | 0.8 | 93.6 | 1.6 | 11.6 | 1.016 | 3.2 | 0.37 | 2.8 | Present Invention Example |
| 40 | Y | 2.9 | 3.1 | 1.1 | 95.0 | 0.8 | 11.6 | 1.019 | 3.6 | 0.36 | 2.2 | Present Invention Example |
| 41 | Z | 2.8 | 1.3 | 1.3 | 94.1 | 3.3 | 11.3 | 1.009 | −4.9 | 0.55 | 2.1 | Present Invention Example |

The underline indicates that the corresponding values are outside the range of the present invention or not preferable properties.

TABLE 6

| Manufacturing No. | Steel No. | Tensile Strength TS MPa | Hole Expansion Rate λ % | Absolute Maximum Value of Straightness at Boundary Between Fractured Surface and Sheared Surface o fEnd Surface – | Limit Fracture Sheet Thickness Reduction Ratio % | Limit Bending R/t – | Remarks |
|---|---|---|---|---|---|---|---|
| 1 | A | 986 | 58 | 1.012 | 78.0 | 2.6 | Present Invention Example |
| 2 | B | 1080 | 78 | 1.028 | 90.1 | 2.4 | Present Invention Example |
| 3 | B | 994 | 58 | 1.045 | 84.7 | 2.7 | Comparative Example |
| 4 | B | 996 | 66 | 1.057 | 85.4 | 2.6 | Comparative Example |
| 5 | B | 983 | 67 | 1.064 | 80.6 | 2.8 | Comparative Example |
| 6 | B | 1005 | 46 | 1.051 | 83.2 | 2.6 | Comparative Example |
| 7 | B | 987 | 49 | 1.047 | 78.4 | 2.9 | Comparative Example |
| 8 | B | 1002 | 50 | 1.055 | 76.8 | 2.8 | Comparative Example |
| 9 | B | 996 | 46 | 1.060 | 89.9 | 2.6 | Comparative Example |
| 10 | B | 987 | 58 | 1.025 | 78.2 | 2.8 | Present Invention Example |
| 11 | B | 946 | 60 | 1.049 | 84.0 | 2.6 | Comparative Example |
| 12 | B | 988 | 58 | 1.042 | 85.6 | 3.1 | Present Invention Example |
| 13 | B | 971 | 59 | 1.062 | 83.3 | 2.7 | Comparative Example |
| 14 | B | 990 | 59 | 1.002 | 61.8 | 2.7 | Comparative Example |
| 15 | B | 997 | 48 | 1.024 | 63.3 | 2.4 | Comparative Example |
| 16 | B | 981 | 57 | 1.053 | 79.3 | 2.6 | Comparative Example |
| 17 | B | 966 | 58 | 1.066 | 71.0 | 2.8 | Comparative Example |
| 18 | C | 1067 | 72 | 1.009 | 85.4 | 2.7 | Present Invention Example |
| 19 | D | 982 | 58 | 1.016 | 75.4 | 2.6 | Present Invention Example |
| 20 | E | 988 | 59 | 1.020 | 92.7 | 2.7 | Present Invention Example |
| 21 | F | 1011 | 61 | 1.010 | 79.7 | 2.8 | Present Invention Example |
| 22 | G | 990 | 59 | 1.002 | 79.8 | 2.5 | Present Invention Example |
| 23 | H | 1026 | 69 | 1.021 | 88.3 | 2.8 | Present Invention Example |
| 24 | I | 1001 | 64 | 1.015 | 85.9 | 2.4 | Present Invention Example |
| 25 | J | 998 | 63 | 1.024 | 77.0 | 2.8 | Present Invention Example |
| 26 | K | 989 | 57 | 1.021 | 78.9 | 2.6 | Present Invention Example |
| 27 | L | 998 | 58 | 1.013 | 93.3 | 3.0 | Present Invention Example |
| 28 | M | 997 | 59 | 1.008 | 85.4 | 2.6 | Present Invention Example |
| 29 | N | 1007 | 65 | 1.021 | 88.3 | 2.7 | Present Invention Example |
| 30 | O | 997 | 60 | 1.008 | 88.0 | 2.6 | Present Invention Example |
| 31 | P | 1020 | 61 | 1.020 | 90.2 | 2.7 | Present Invention Example |
| 32 | Q | 961 | 51 | 1.063 | 85.5 | 3.8 | Comparative Example |
| 33 | R | 973 | 60 | 1.049 | 88.6 | 2.7 | Comparative Example |
| 34 | S | 972 | 59 | 1.010 | 86.3 | 2.6 | Comparative Example |
| 35 | T | 958 | 59 | 1.047 | 69.0 | 3.3 | Comparative Example |
| 36 | U | 963 | 64 | 1.054 | 77.4 | 2.6 | Comparative Example |
| 37 | V | 994 | 60 | 1.055 | 83.9 | 2.7 | Comparative Example |
| 38 | W | 982 | 60 | 1.010 | 78.6 | 2.9 | Present Invention Example |
| 39 | X | 986 | 57 | 1.004 | 77.4 | 3.0 | Present Invention Example |
| 40 | Y | 994 | 55 | 1.035 | 75.4 | 2.8 | Present Invention Example |
| 41 | Z | 981 | 59 | 1.027 | 80.1 | 2.9 | Present Invention Example |

The underline indicates that the corresponding values are outside the range of the present invention or not preferable properties.

From Tables 5 and 6, it is found that the hot-rolled steel sheets according to the present invention examples have excellent hole expansibility and shearing property while having a high strength and a high limit fracture sheet thickness reduction ratio. In addition, it is found that among the present invention examples, the hot-rolled steel sheets in which the average crystal grain size of the surface layer is less than 3.0 μm have the above various properties and further have excellent inside bend cracking resistance.

On the other hand, it is found that the hot-rolled steel sheets according to the comparative examples deteriorate in any one or more of strength, hole expansibility, limit fracture sheet thickness reduction ratio, and shearing property.

INDUSTRIAL APPLICABILITY

In the aspect according to the present invention, it is possible to provide a hot-rolled steel sheet that has a high strength, a high limit fracture sheet thickness reduction ratio, and excellent hole expansibility and shearing property. In addition, in the preferable aspect according to the present invention, it is possible to obtain a hot-rolled steel sheet that has the above various properties and, furthermore, suppresses the occurrence of inside bend cracking, that is, has excellent inside bend cracking resistance.

The hot-rolled steel sheet according to the present invention is suitable as an industrial material used for vehicle members, mechanical structural members, and building members.

What is claimed is:

1. A hot-rolled steel sheet comprising, as a chemical composition, by mass %:

C: 0.040% to 0.250%;
Si: 0.05% to 3.00%;
Mn: 1.00% to 4.00%;
sol. Al: 0.001% to 0.500%;
P: 0.100% or less;
S: 0.0300% or less;
N: 0.1000% or less;
O: 0.0100% or less;
Ti: 0% to 0.300%;
Nb: 0% to 0.100%;
V: 0% to 0.500%;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.0200%;
As: 0% to 0.100%;
Zr: 0% to 1.00%;
Co: 0% to 1.00%;
Zn: 0% to 1.00%;
W: 0% to 1.00%;
Sn: 0% to 0.05%; and
a remainder: Fe and impurities,
wherein Expression (A) is satisfied,
a microstructure includes, by area %,
martensite and tempered martensite of more than 92.0% and 100.0% or less in total,
residual austenite of less than 3.0%,
ferrite of less than 5.0%, and
in which an entropy value represented by Expression (1), obtained by analyzing an SEM image of the microstructure using a gray-level co-occurrence matrix method, is 11.0 or more,
an inverse difference normalized value represented by Expression (2) is less than 1.020,
a cluster shade value represented by Expression (3) is $-8.0\times10^5$ to $8.0\times10^5$, and
a standard deviation of an Mn concentration is 0.60 mass % or less, and
a tensile strength is 980 MPa or more, $$Zr + Co + Zn + W \leq 1.00\% \quad (A)$$

where each element symbol in Expression (A) represents an amount of the corresponding element by mass %, and 0% is substituted in a case where the corresponding element is not contained,
here, P(i, j) in Expressions (1) to (5) is a gray-level co-occurrence matrix, L in Expression (2) is the number of grayscale levels that can be taken in the SEM image, i and j in Expressions (2) and (3) are natural numbers of 1 to L, and $\mu_x$ and $\mu_y$ in Expression (3) are each represented by Expressions (4) and (5), $$\text{Entropy} = -\sum_i \sum_j P(i, j) \cdot \log(P(i, j)) \quad (1)$$

$$\text{Inverse difference normalized} = \sum_i \sum_j \frac{P(i, j)}{1 + \frac{|i-j|}{L}} \quad (2)$$

$$\text{Cluster Shade} = \sum_i \sum_j (i + j - \mu_x - \mu_y)^3 P(i, j) \quad (3)$$

$$\mu_x = \sum_i \sum_j i(P(i, j)) \quad (4)$$

$$\mu_y = \sum_i \sum_j j(P(i, j)). \quad (5)$$

2. The hot-rolled steel sheet according to claim 1, wherein an average crystal grain size of a surface layer is less than 3.0 μm.

3. The hot-rolled steel sheet according to claim 1, wherein the chemical composition contains, by mass % one or more of Ti: 0.001% to 0.300%,
Nb: 0.001% to 0.100%,
V: 0.001% to 0.500%,
Cu: 0.01% to 2.00%,
Cr: 0.01% to 2.00%,
Mo: 0.01% to 1.00%,
Ni: 0.01% to 2.00%,
B: 0.0001% to 0.0100%,
Ca: 0.0001% to 0.0200%,
Mg: 0.0001% to 0.0200%,
REM: 0.0001% to 0.1000%,
Bi: 0.0001% to 0.0200%,
As: 0.001% to 0.100%,
Zr: 0.01% to 1.00%,
Co: 0.01% to 1.00%,
Zn: 0.01% to 1.00%,
W: 0.01% to 1.00%, and
Sn: 0.01% to 0.05%.

4. The hot-rolled steel sheet according to claim 2, wherein the chemical composition contains, by mass %, one or more of Ti: 0.001% to 0.300%,
Nb: 0.001% to 0.100%,
V: 0.001% to 0.500%,
Cu: 0.01% to 2.00%,
Cr: 0.01% to 2.00%,
Mo: 0.01% to 1.00%,
Ni: 0.01% to 2.00%,
B: 0.0001% to 0.0100%,
Ca: 0.0001% to 0.0200%,
Mg: 0.0001% to 0.0200%,
REM: 0.0001% to 0.1000%,
Bi: 0.0001% to 0.0200%,
As: 0.001% to 0.100%,
Zr: 0.01% to 1.00%,
Co: 0.01% to 1.00%,
Zn: 0.01% to 1.00%,
W: 0.01% to 1.00%, and
Sn: 0.01% to 0.05%.

* * * * *